United States Patent [19]

Mihayashi et al.

[11] Patent Number: 4,618,572

[45] Date of Patent: Oct. 21, 1986

[54] SILVER HALIDE PHOTOGRAPHIC LIGHT-SENSITIVE MATERIAL

[75] Inventors: Keiji Mihayashi; Hidetoshi Kobayashi; Shunji Takada, all of Kanagawa, Japan

[73] Assignee: Fuji Photo Film Co., Ltd., Kanagawa, Japan

[21] Appl. No.: 680,632

[22] Filed: Dec. 12, 1984

[30] Foreign Application Priority Data

Dec. 15, 1983 [JP] Japan ..... 58-237108

[51] Int. Cl.[4] ..... G03C 7/26

[52] U.S. Cl. ..... 430/543; 430/553; 430/555; 430/557; 430/558; 430/598; 430/955

[58] Field of Search ..... 430/543, 553, 555, 557, 430/558, 598, 955

[56] References Cited

U.S. PATENT DOCUMENTS

| | | | |
|---|---|---|---|
| 3,253,924 | 5/1966 | Loria et al. | 430/553 |
| 4,371,604 | 2/1983 | Van de Sande et al. | 430/543 |
| 4,390,618 | 6/1983 | Kobayashi et al. | 430/955 |
| 4,482,629 | 11/1984 | Nakagawa et al. | 430/955 |
| 4,499,181 | 2/1985 | Watanabe et al. | 430/598 |
| 4,500,636 | 2/1985 | Ono et al. | 430/955 |

*Primary Examiner*—J. Travis Brown

*Attorney, Agent, or Firm*—Sughrue, Mion, Zinn, Macpeak & Seas

[57] ABSTRACT

A silver halide photographic light-sensitive material is disclosed, comprising a support having provided thereon at least one silver halide emulsion layer and containing, in a silver halide emulsion layer having an average iodide content of about 8 mol % or more, a compound capable of releasing a fogging agent or a precursor thereof, or of releasing a development accelerator or a precursor thereof upon development in proportion to the amount of developed silver.

19 Claims, No Drawings

SILVER HALIDE PHOTOGRAPHIC LIGHT-SENSITIVE MATERIAL

FIELD OF THE INVENTION

This invention relates to a silver halide photographic light-sensitive material and, more particularly, to a silver halide photographic light-sensitive material having both high sensitivity and improved graininess.

BACKGROUND OF THE INVENTION

In recent years, silver halide photographic light-sensitive materials, particularly light-sensitive materials for photographing use, are required to possess enough high image quality and resolving power to be adapted for high speed light-sensitive materials such as color negative-working light-sensitive materials of ISO 1,000 or small-format cameras such as 110-size cameras or disc cameras.

Regarding high speed light-sensitive materials, various techniques have hitherto been examined such as these to coarsen silver halide grains, to enhance activity of couplers, and to accelerate development. The technique of coarsening silver halide grains has seen almost the maximum limit of sensitivity, and a further great increase in sensitivity cannot be expected from this technique as has been reported by G. C. Farnell and J. B. Chanter, *J. Photogr. Sci.,* Vol. 9, p. 75 (1961). In addition, coarsening of silver halide grains is accompanied by various problems such as deterioration of graininess.

Many investigations have hitherto been made on enhancement of coupler activity. However, their contributions to the sensitivity of light-sensitive material have been insufficient. Further, enhancement of coupler activity causes deterioration of graininess.

As to the technique of accelerating development, it has conventionally been attempted to add various development accelerators such as a hydrazine compound to an emulsion layer or to a developer mainly with respect to black-and-white light-sensitive materials. In many cases, however, this technique involves more fogging or deterioration of graininess and thus is not practical.

Accordingly, it has been proposed to use couplers capable of imagewise releasing a development accelerator or a fogging agent. For example, U.S. Pat. Nos. 3,214,377 and 3,253,924 and Japanese Patent Application (OPI) No. 17437/76 (corresponding to U.S. Pat. No. 4,032,345) (the term "OPI" as used herein refers to a "published unexamined Japanese patent application") disclose couplers capable of releasing thiocyanate ion which accelerates solution physical development. Japanese Patent Application (OPI) No. 150845/82 (corresponding to U.S. Pat. No. 4,390,618) describes couplers capable of releasing acylhydrazines, and Japanese Patent Application (OPI) No. 138636/82 describes couplers capable of releasing hydroquinone, aminophenol developing agent, etc.

It is true that these couplers can provide in some cases more contrast and higher sensitivity, but it has become apparent that, in comparison with the case of not using them, there arises a problem of deterioration of graininess particularly upon low-exposure.

On the other hand, it has become apparent that silver halide grains having an increased silver iodide content can absorb more light rays and provide higher sensitivity but, as is described in Japanese Patent Application (OPI) No. 100846/83, they have the problem of an increase in number of silver halide grains not utilized in image formation (dead grains), which results in deterioration of developability.

Further, since development using p-phenylenediamine type developing agents or using D-76 (which is a developer manufactured and sold by Eastman Kodak Company) or metolascorbic acid surface developer which is popularly conducted at present is the so-called parallel type development in which individual silver halide grains are gradually developed in a parallel manner, the rate of parallel type development of individual grains containing a higher content of silver iodide is much slower than that by the so-called granular type development [using, for example, D-19 or D-72 (which is each a developer manufactured and sold by Eastman Kodak Company)] in which individual silver halide grains are developed at once. Thus, a problem arises in that sufficient sensitivity cannot be attained though the latent image is sufficiently formed or that the graininess in high-exposure portions becomes coarse.

SUMMARY OF THE INVENTION

An object of the present invention is to provide an extremely high-speed silver halide photographic light-sensitive material.

Another object of the present invention is to provide a silver halide photographic light-sensitive material having high sensitivity and improved graininess.

A further object of the present invention is to provide a silver halide photographic light-sensitive material having high sensitivity and an excellent developing rate.

Still a further object of the present invention is to provide a silver halide photographic light-sensitive material having good preservability.

These and other objects of the present invention will become apparent from the following description thereof.

The above-described and other objects of the present invention are attained by a silver halide photographic light-sensitive material comprising a support having provided thereon at least one silver halide emulsion layer and containing, in a silver halide emulsion layer having an average silver iodide content of about 8 mol% or more, a compound capable of releasing a fogging agent or a precursor thereof, or releasing a development accelerator or a precursor thereof upon development in proportion to the amount of developed silver.

DETAILED DESCRIPTION OF THE INVENTION

The reasons for the high sensitivity and good graininess obtained by the present invention are not clear, but are believed to be as follows. Since grains with low developability contained in a silver halide emulsion of high silver iodide content become developable by the compound of the present invention, the number or population of development-initiating sites increases to enhance sensitivity, and graininess of high-exposure portions which has conventionally been made coarse due to delayed development is improved by the development-accelerating effect of the compound of the present invention, leading to improved graininess (i.e., disappearance of graininess).

The compounds to be used in the present invention capable of releasing a fogging agent or a precursor thereof, or releasing a development accelerator or a precursor thereof upon development in proportion to the amount of developed silver (hereinafter abbreviated as FR compounds) are added to a silver halide emulsion layer containing silver halide grains of high silver halide content in amounts of preferably $10^{-8}$ to $5\times10^{-1}$ mol, particularly preferably $5\times10^{-7}$ to $10^{-2}$ mol, per mol of silver halide. The same means as is employed for adding couplers to emulsion layers to be described hereinafter may be employed for adding the FR compounds to be emulsion layer.

Specific examples of the FR compounds to be used in the present invention include the following compounds:

(i) couplers capable of coupling with an oxidation product of an aromatic primary amine developing agent to release a fogging agent, a development accelerator, or a precursor thereof;

(ii) couplers capable of coupling with an oxidation product of an aromatic primary amine developing agent to form a diffusible (colored or colorless) dye having a fogging moiety or a development-accelerating moiety, or a precursor thereof; and (iii) compounds causing an oxidation-reduction reaction with an oxidation product of a developing agent and releasing a fogging agent, a development accelerator, or a precursor thereof by hydrolysis reaction to be caused subsequent to the oxidation-reduction reaction.

The compounds of the present invention, (i), (ii), and (iii), are represented by the following general formulae (1), (2), and (3), respectively.

(1) COUP-1-(TIME-1)$_n$-FA (2) FOG-(COUP-2)-BALL (3) RED-W

In the above general formulae (I), COUP-1 represents a coupler moiety capable of causing a coupling reaction with an oxidation product of an aromatic primary amine developing agent, (TIME-1)$_n$-FA represents a moiety containing a group to be released by the coupling reaction and capable of fogging silver halide or capable of accelerating development, or a precursor thereof.

The coupler moiety represented by COUP-1 may be that which is known in the art or is being used.

A cyan coupler moiety includes a phenol coupler moiety, etc. A magenta coupler moiety includes a 5-pyrazolone coupler moiety, a pyrazolobenzimidazole coupler moiety, a pyrazolotriazole coupler moiety, a cyanoacetylcoumarone coupler moiety, an open-chain acylacetonitrile coupler moiety, etc. A yellow coupler moiety includes an acylacetanilide coupler moiety (e.g., a benzoylacetanilide coupler moiety, a pivaloylacetanilide coupler moiety, etc.), a malonedianilide coupler moiety, etc. A non-color forming coupler moiety whose coupling product with an oxidation product of an aromatic primary developing agent does not have distinct visible absorption includes a moiety of open-chain or cyclic active methylene compounds (e.g., indanones, cyclopentanones, cyclohexanones, malonic diesters, acetophenones, imidazolones, oxazolones, thiazolones, etc.). However, the hue of the coupling product produced by the reaction between COUP-1 and the oxidation product of an aromatic primary amine developing agent is not limited to the above-described hues and may be any other hue.

Examples of the coupler moiety represented by COUP-1 are illustrated below:

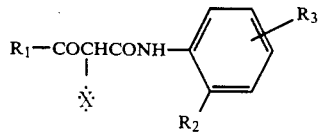

(I)

wherein $R_1$ represents an alkyl group, an aryl group, a heterocyclic group, an alkoxy group, an alkylamino group or an anilino group, $R_2$ represents a hydrogen atom, a halogen atom, an alkyl group, an alkoxy group or an aryloxy group, $R_3$ represents a hydrogen atom, an alkyl group, an alkoxy group, an acyl group, an aryloxy group, a sulfonyl group, a carbonamido group, a hydroxy group, a carboxy group, a sulfo group, a sulfonamido group, an alkoxycarbonyl group, a carbamoyl group, a sulfamoyl group, a ureido group or a halogen atom, and the sum of the number of carbon atoms of $R_1$, $R_2$ and $R_3$ ranges from 1 to 40, preferably from 4 to 32;

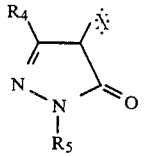

(II)

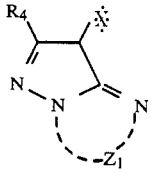

(III)

wherein $R_4$ represents an alkoxy group, an alkylamino group, a dialkylamino group, an alkyl group, a carbonamido group or a sulfonamido group, $R_5$ represents an alkyl group or an aryl group, $Z_1$ represents non-metallic atoms necessary for forming a 5-membered azole ring (e.g., an imidazole ring, a triazole ring, a tetrazole ring, etc.), provided that the general formula (III) includes the tautomers thereof, the sum of the number of carbon atoms of $R_4$ and $R_5$ ranges from 2 to 40, preferably from 7 to 32, and the sum of the number of carbon atoms of $R_4$ and $Z_1$ ranges from 1 to 40, preferably from 2 to 32;

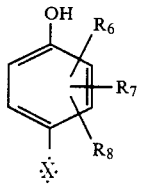

(IV)

-continued

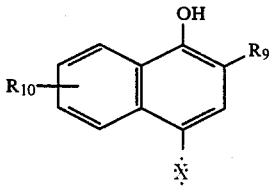

(V)

wherein $R_6$, $R_7$, and $R_8$ may be the same or different and each represents a hydrogen atom, a halogen atom, an alkyl group, an alkoxy group, an alkylthio group, a ureido group, a carbonamido group or a sulfonamido group, the sum of the number of carbon atoms of $R_6$, $R_7$ and $R_8$ ranges from 3 to 40, preferably from 7 and 32, $R_9$ represents a carbamoyl group or an alkoxycarbonyl group, $R_{10}$ represents a hydrogen atom, a halogen atom, an alkyl group, an alkoxy group or an alkylthio group, and the sum of the number of carbon atoms of $R_9$ and $R_{10}$ ranges from 1 to 40, preferably from 2 to 32;

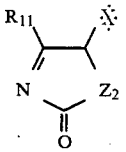

(VI)

wherein $R_{11}$ represents an alkyl group, an aryl group, an anilino group, an alkylamino group or an alkoxy group, $Z_2$ represents an oxygen atom, a sulfur atom or a nitrogen atom, and the sum of the number of carbon atoms of $R_{11}$ and $Z_2$ range from 1 to 40, preferably from 4 to 32;

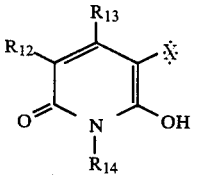

(VII)

wherein $R_{12}$ and $R_{13}$ each represents a hydrogen atom, a cyano group, an alkoxycarbonyl group, a carbamoyl group, a sulfo group or an acyl group, $R_{14}$ represents a hydrogen atom, an alkyl group, an aryl group or a heterocyclic group, and the sum of the number of carbon atoms of $R_{12}$, $R_{13}$ and $R_{14}$ ranges from 1 to 40, preferably from 4 to 32;

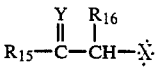

(VIII)

-continued

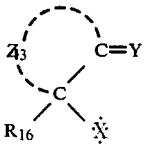

(IX)

wherein $R_{15}$ represents an alkyl group, an aryl group, a heterocyclic group, a cyano group, a hydroxy group, an alkoxy group, an aryloxy group, a hetero ring oxy group, an alkylamino group, a dialkylamino group, an anilino group, a sulfonyl group, a sulfamoyl group or an ammoniumyl group, $R_{16}$ represents a hydrogen atom, an alkyl group, an aryl group, a halogen atom, an alkoxy group, an acyloxy group, or a heterocyclic group, Y represents an oxygen atom or $=N-R_{17}$, and $R_{17}$ represents an alkyl group, an aryl group, a hydroxy group, an alkoxy group or a sulfonyl group, $Z_3$ represents non-metallic atoms necessary for forming, together with a

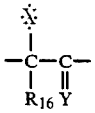

portion of the general formula (IX), a 5- to 7-membered carbon ring (e.g., an indanone ring, a cyclopentanone ring, a cyclohexanone ring, etc.) or a hetero ring (e.g., a piperidone ring, a pyrrolidone ring, a hydrocarbostyryl ring, etc.), the sum of the number of carbon atoms of $R_{15}$, $R_{16}$ and $R_{17}$ ranges from 1 to 40, preferably from 4 to 32, and the sum of the number of carbon atoms of $R_{16}$, $R_{17}$ and $Z_3$ ranges from 3 to 40, preferably from 4 to 32; and

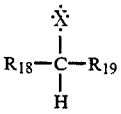

(X)

wherein $R_{18}$ and $R_{19}$ may be the same or different and each represents an alkoxycarbonyl group, a carbamoyl group, an acyl group, a cyano group, a formyl group, a sulfonyl group, a sulfinyl group, a sulfamoyl group, an ammoniumyl group or

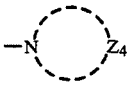

(wherein $Z_4$ represents non-metallic atoms necessary for forming, together with

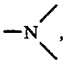

a 5- to 7-membered ring, such as a phthalimide ring, a triazole ring or a tetrazole ring), and p1 the sum of the number of carbon atoms of $R_{18}$ and $R_{19}$ ranges from 2 to 40, preferably from 4 to 32.

In the above formulae (I) to (X), ⁜ represents the position to which $(TIME\text{-}1)_n$-FA is bound.

As the timing group represented by TIME-1, there are illustrated those which cleave from COUP upon coupling reaction and then release FA by intramolecular displacement reaction as described in U.S. Pat. No. 4,248,962, Japanese Patent Application (OPI) No. 56837/82, etc.; those which release FA through electron transfer via conjugation system as described in British Pat. No. 2,072,363A, Japanese Patent Application (OPI) Nos. 154234 (corresponding to U.S. Pat. No. 4,421,845) and 188035/82, etc., and those which are coupling components capable of releasing FA upon coupling reaction with an oxidation product of an aromatic primary amine developing agent as described in Japanese Patent Application (OPI) No. 111536/82 (corresponding to U.S. Pat. No. 4,438,193).

n represents 0 or 1.

FA represents when n=0, a group capable of being cleaved from COUP-1 upon coupling reaction or represents, when n=1, a group to be released from TIME-1, which has the effect of substantially fogging silver halide grains or of accelerating development.

Examples of FA include those groups which are represented by $(L)_m$-X wherein L represents a divalent linking group, X represents a reductive group or a group capable of forming silver sulfide upon development, and m represents 0 or 1. Where FA represents a group of $(L)_m$-X, FA may be attached to TIME-1 in any position on $(L)_m$-X.

Either L or X may be attached to the coupling carbon atom as long as L or X can be cleaved upon the coupling reaction. In addition, a group known as 2-equivalent coupling-off group may exist between the coupling carbon atom and L or X. Such groups include an alkoxy group (e.g., a methoxy group), an aryloxy group (e.g., a phenoxy group), an alkylthio group (e.g., an ethylthio group), an arylthio group (e.g., a phenylthio group), a hetero ring oxy group (e.g., a tetrazolyloxy group), a heterocyclic thio group (e.g., a pyridylthio group), a heterocyclic group (e.g., a hydantoinyl group, a pyrazolyl group, a triazolyl group, a benzotriazolyl group, etc.), etc. In addition, those described in Published Unexamined British Patent Application No. 2,011,391 may be used as FA.

The divalent linking group L in FA is constituted by a member selected from those usually employed such as alkylene, alkenylene, phenylene, naphthylene, —O—, —S—. —SO—, —$SO_2$—, —N=—, carbonamido, thioamido, sulfonamido, ureido, thioureido, hetero ring, etc.

As the group represented by X, there are illustrated those which comprise a reductive compound (e.g., hydrazine, hydrazide, hydrazone, hydroquinone, catechol, p-aminophenol, p-phenylenediamine, 1-phenyl-3-pyrazolidinone, enamine, aldehyde, polyamine, acetylene, aminoborane, quaternary salts represented by tetrazolium salt, ethylene-bis(pyridinium) salts, carbazic acid, etc.) or a compound capable of forming silver sulfide upon development (e.g., those having a partial structure of

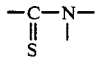

such as thiourea, thioamide, dithiocarbamate, rhodanine, thiohydantoin, thiazolidinethione, etc.).

Some of the group represented by X and capable of forming silver sulfide upon development possess properties to adsorb on silver halide grains, thus being able to also function as adsorptive group to be described hereinafter.

Examples of L are illustrated below:

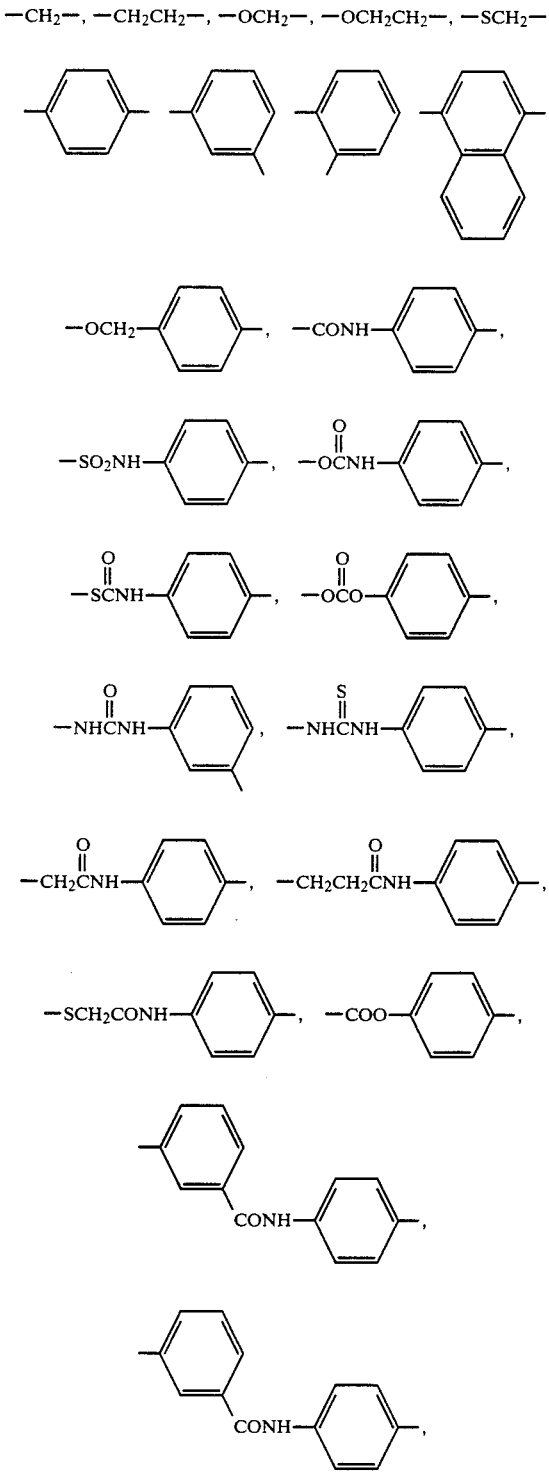

-continued
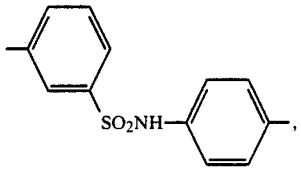
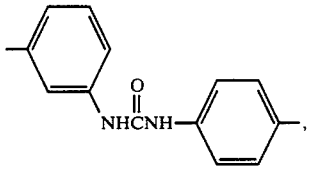
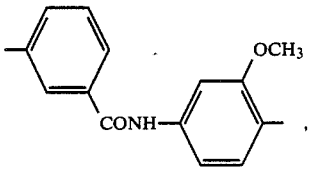
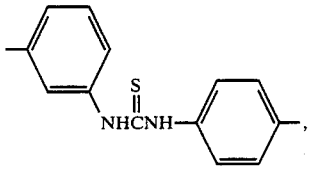
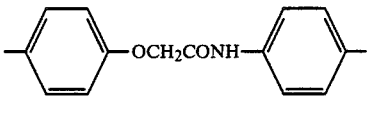
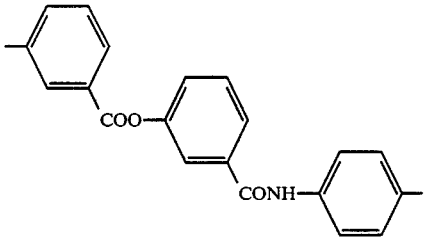
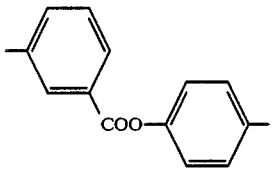
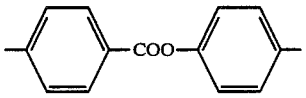
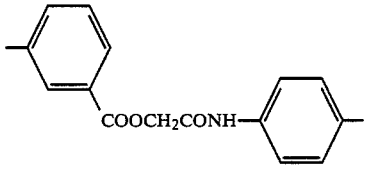
-continued
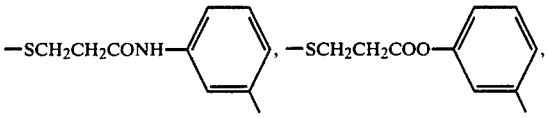
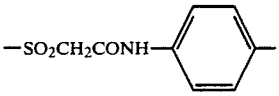
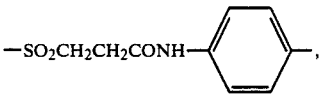
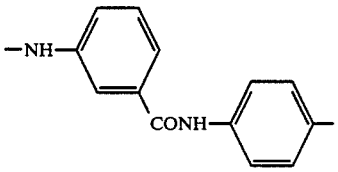
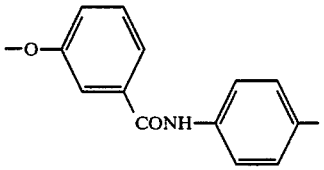
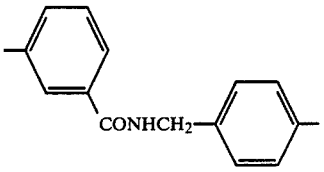
Examples of X are illustrated below:
$-NHNHCHO$, $-NHNHCOCH_3$, $-NHNHSO_2CH_3$,
$-NHNHCOCF_3$ $-\underset{\underset{COOC_2H_5}{|}}{N}-NHCHO$,
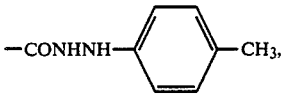
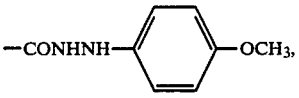
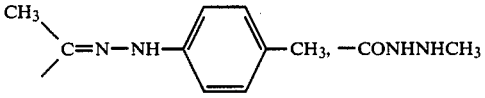
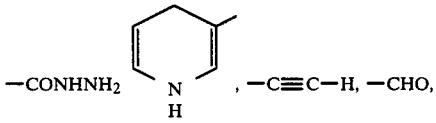

-continued

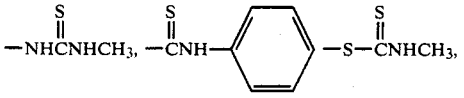

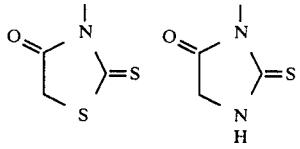

As the group represented by FA, those which contain a group adsorptive on silver halide grains are particularly preferable. Such adsorptive group may exist either in L or in X. As the silver halide-adsorptive group, there are illustrated those which comprise a nitrogen-containing hetero ring having a dissociative hydrogen atom (e.g., pyrrole, imidazole, pyrazole, triazole, tetrazole, benzimidazole, benzopyrazole, benzotriazole, uracil, tetrazaindene, imidazotetrazole, pyrazolotriazole, pentazaindene, etc.), a hetero ring having at least one nitrogen atom and other hetero atom (e.g., an oxygen atom, a sulfur atom, a selenium atom, etc.) within the ring (e.g., oxazole, thiazole, thiazolidine, thiadiazole, benzothiazole, benzoxazole, etc.), a mercapto group-containing hetero ring (e.g., 2-mercaptobenzothiazole, 2-mercaptopyrimidine, 2-mercaptobenzoxazole, 1-phenyl-5-mercaptotetrazole, etc.), a quaternary salt (e.g., quaternary salts of tertiary amine, pyridine, quinoline, benzothiazole, benzimidazole, benzoxazole, etc.), a thiophenol, an alkylthiol (e.g., cysteine, etc.), a compound having a partial structure of

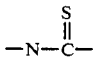

(e.g., thiourea, dithiocarbamate, thioamide, rhodanine, thiazolidinethione, thiohydantoin, thiobarbituric acid, etc.), or the like.

As a group linking these adsorptive groups to L or X there are those which are constituted by usually employed members selected from alkylene, alkenylene, phenylene, naphthylene, —O—, —S—, —SO—, —$SO_2$—, —N=N—, carbonylamido, thioamido, sulfonamido, ureido, thioureido, hetero ring, etc.

Examples of the adsorptive groups are given below:

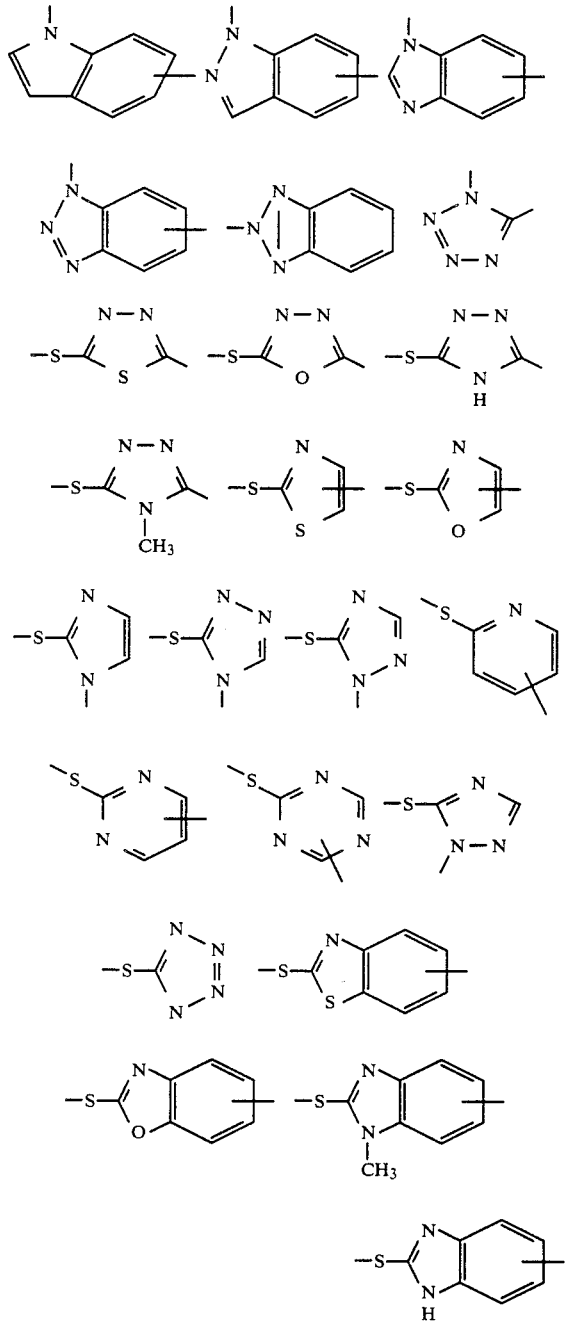

Specific examples of the group represented by FA are given below:

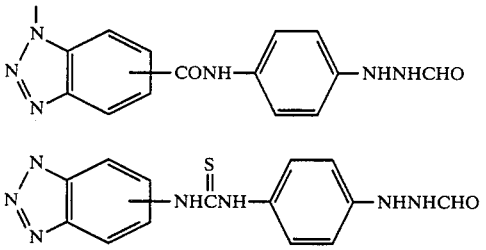

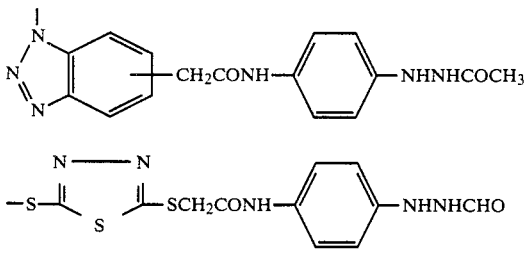

-continued
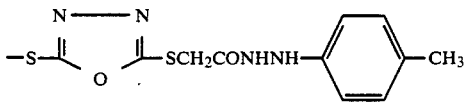
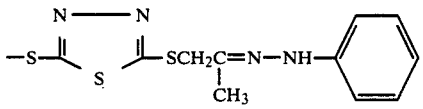
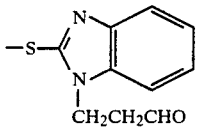
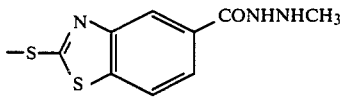
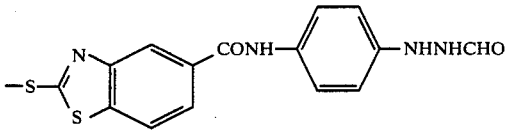
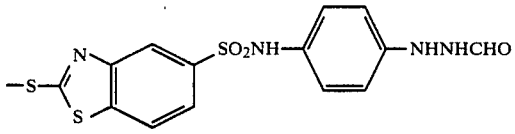
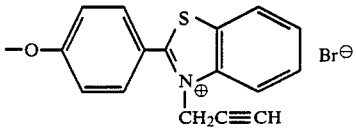
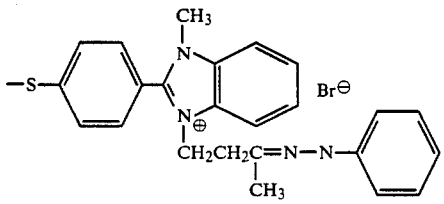
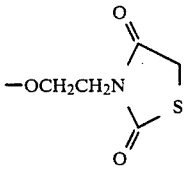
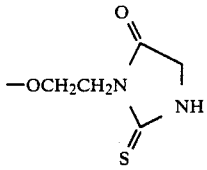
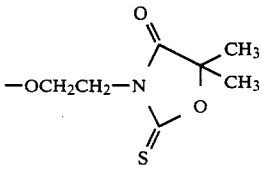
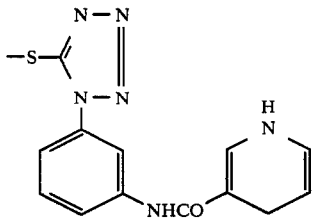
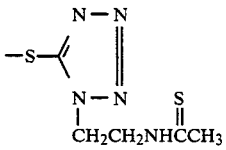
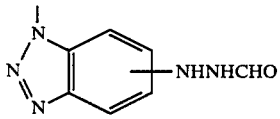
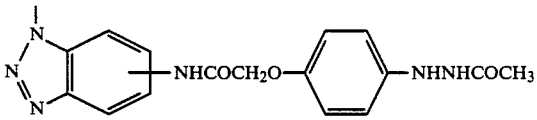
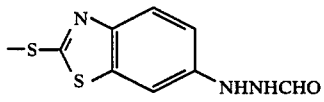
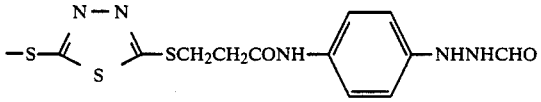
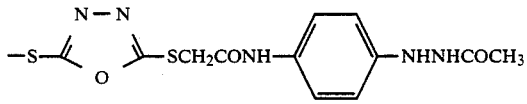
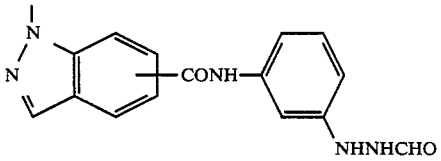
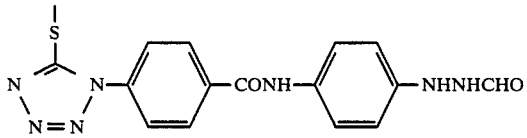

-continued
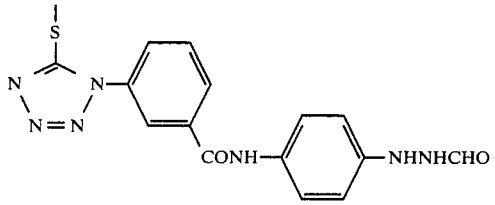
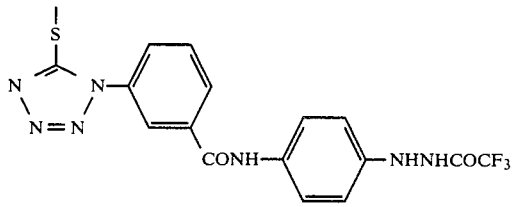
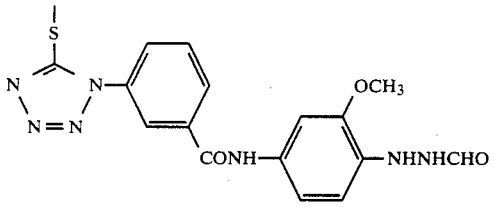
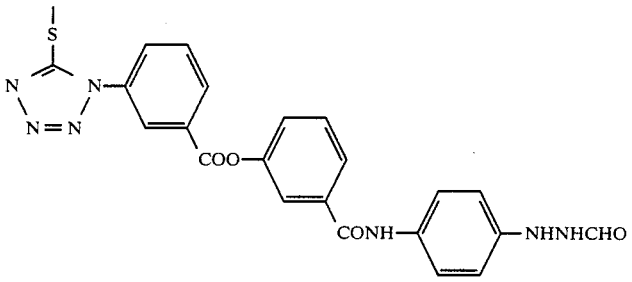
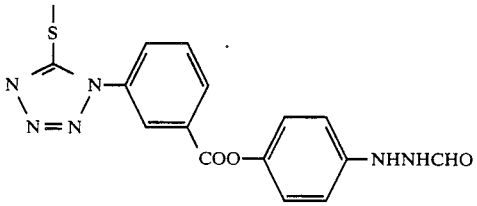
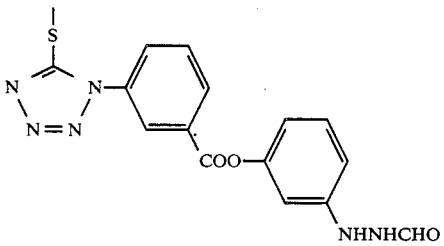
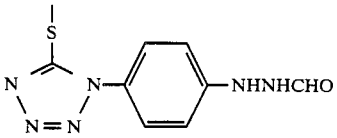
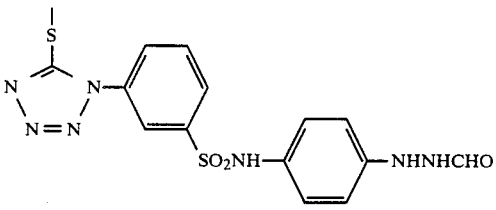
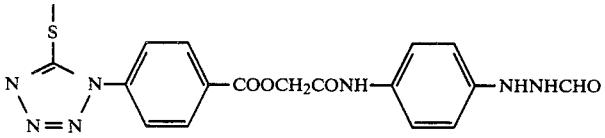
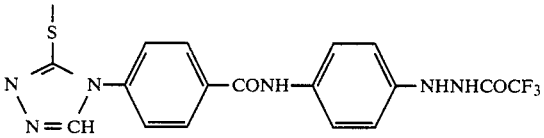
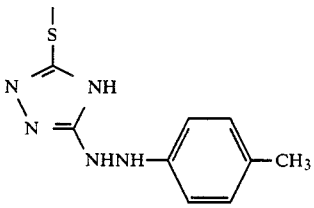

-continued
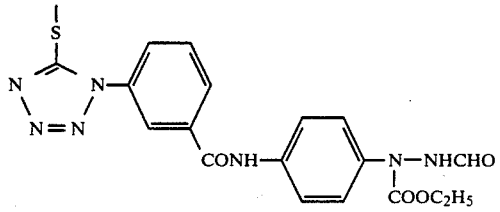
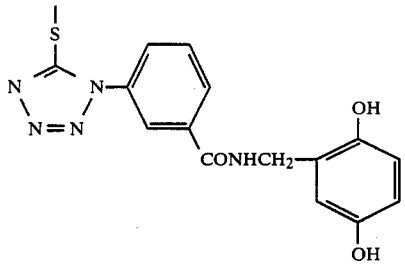
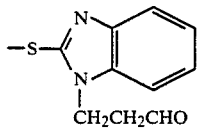
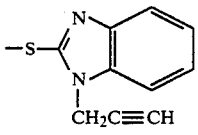
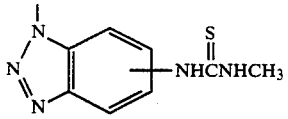
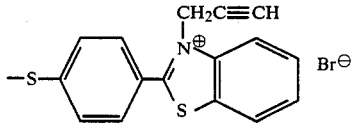
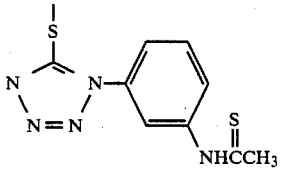
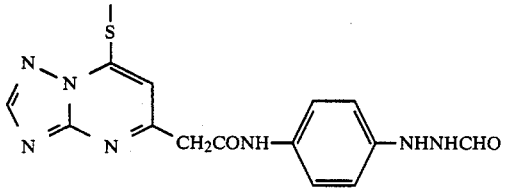
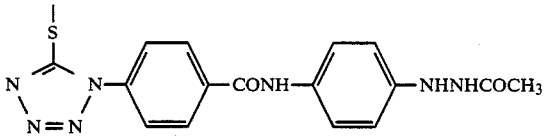
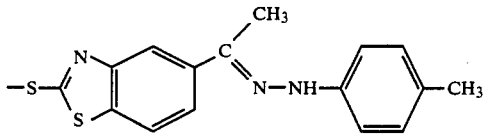
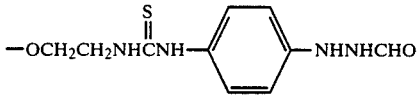
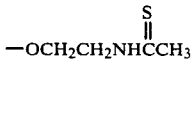
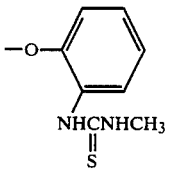
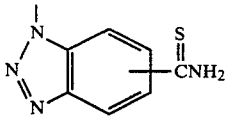
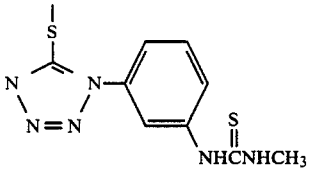
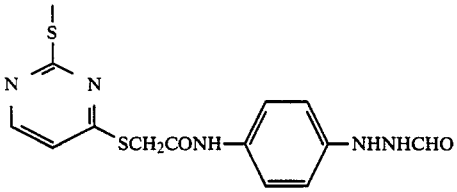
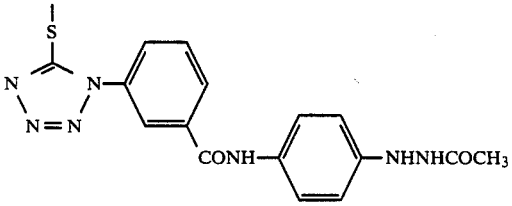
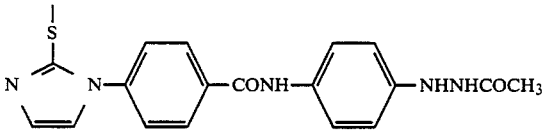

-continued
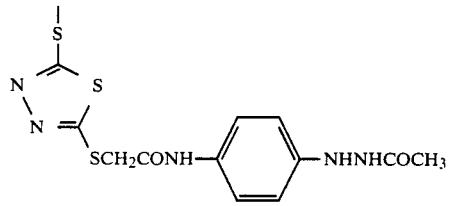
Specific examples of the compounds represented by the general formula (I) are illustrated below, which however are not to be construed as limitative at all.
(I-1)
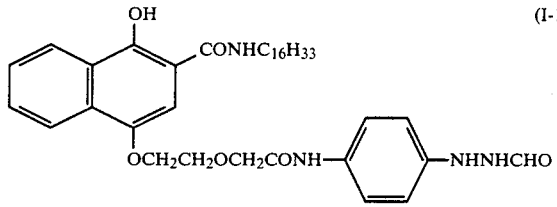
(I-2)
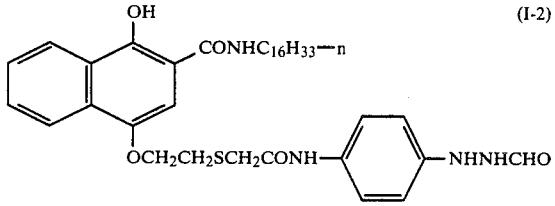
(I-3)
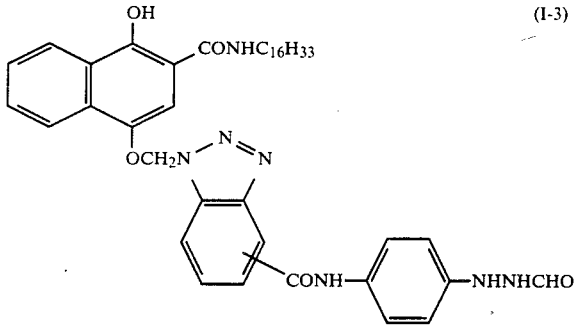
(I-4)
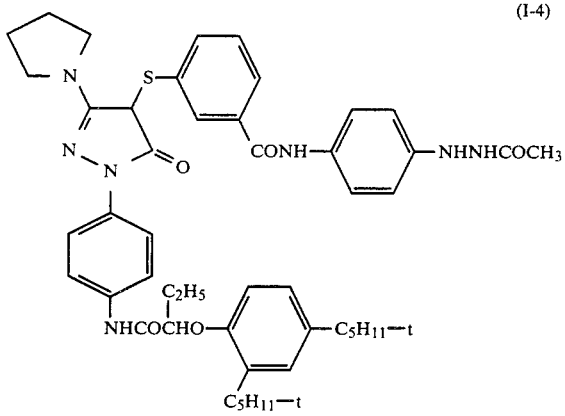
(I-5)
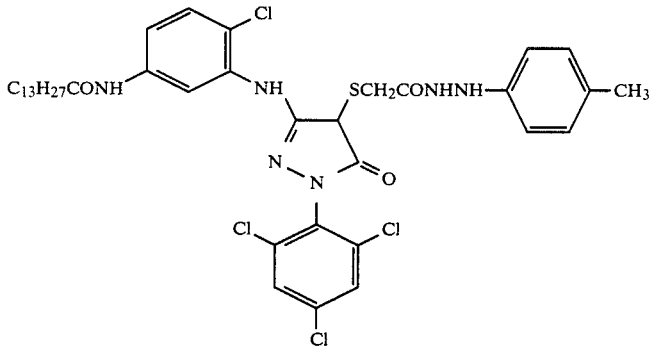
(I-6)
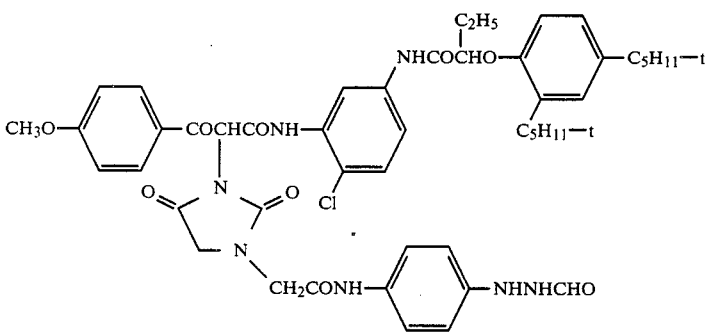

-continued
(I-7)
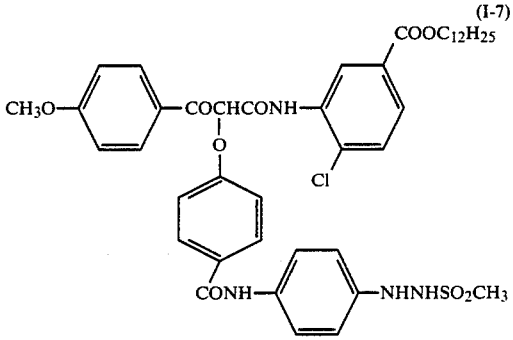
(I-8)
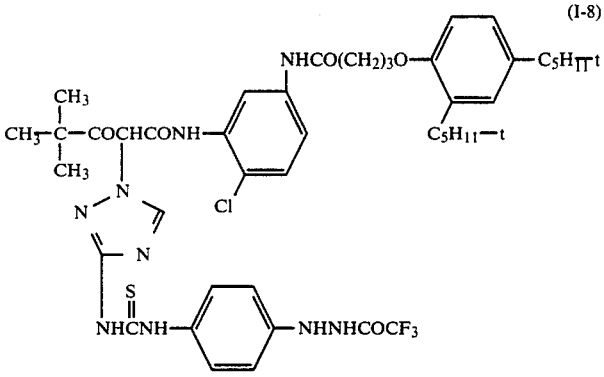
(I-9)
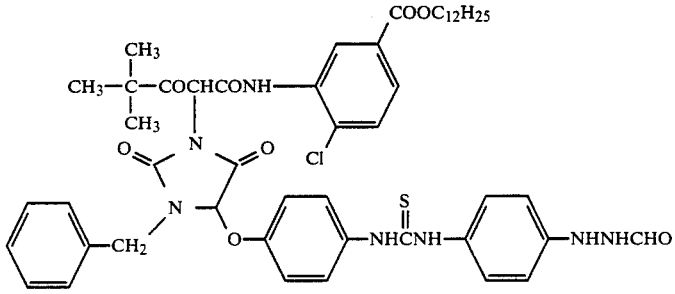
(I-10)
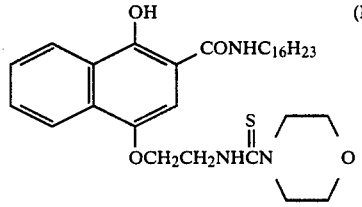
(I-11)
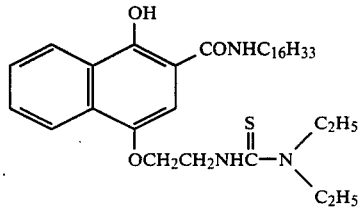
(I-12)
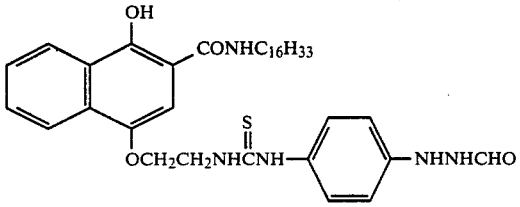
(I-13)
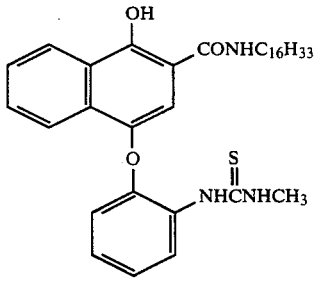
(I-14)
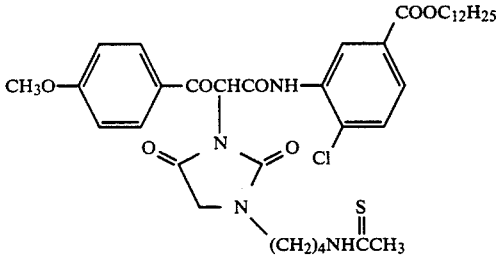
(I-15)
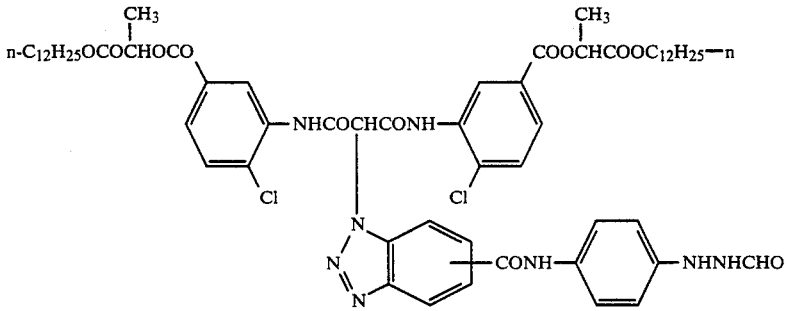

-continued
(I-16)
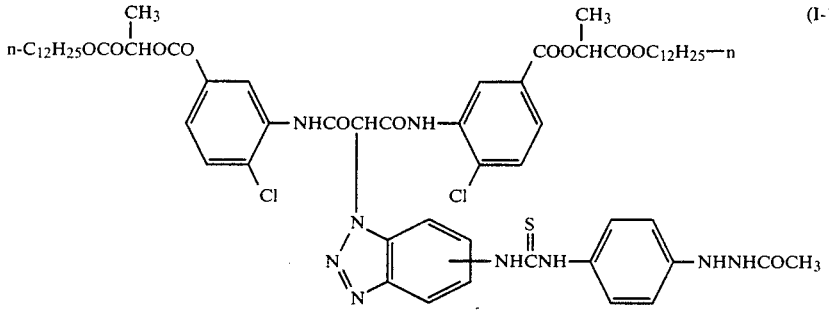
(I-17)
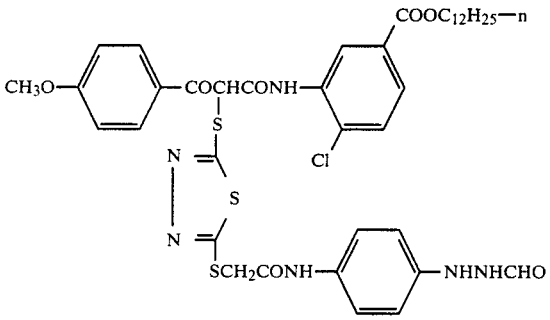
(I-18)
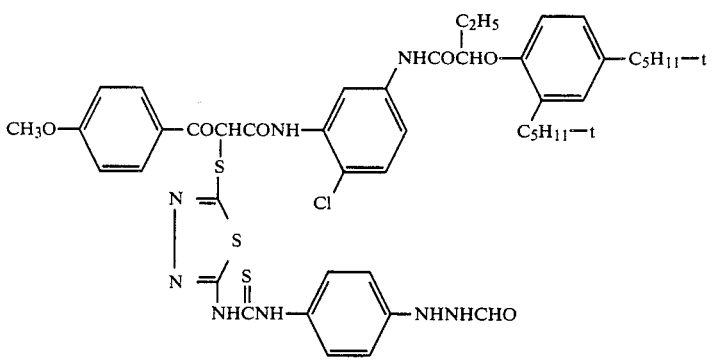
(I-19)
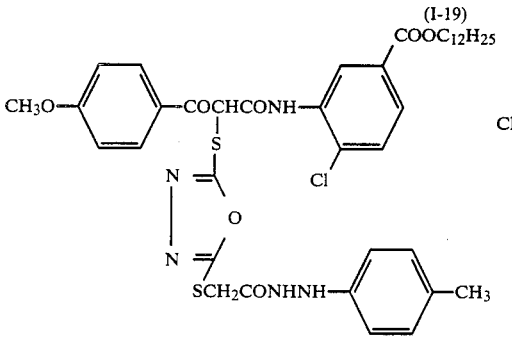
(I-20)
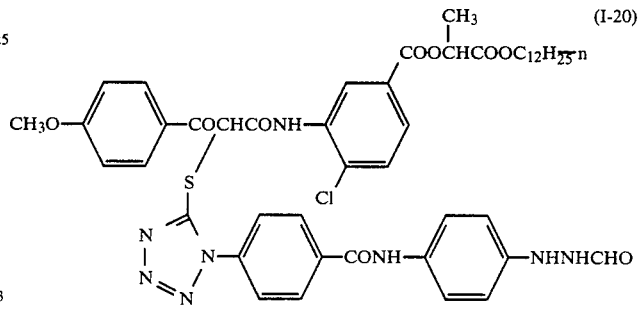

-continued
(I-21)
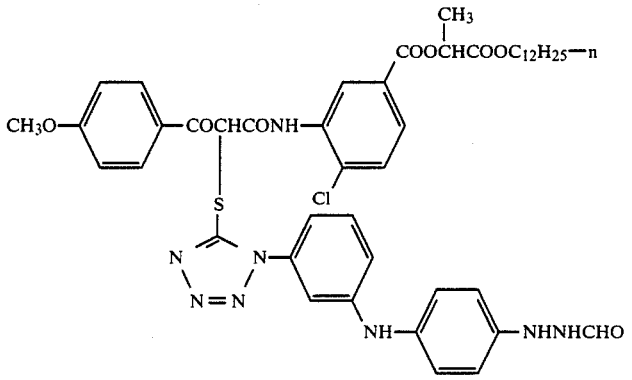
(I-22)
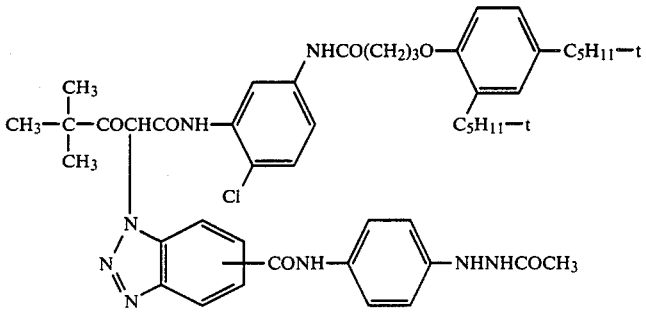
(I-23)
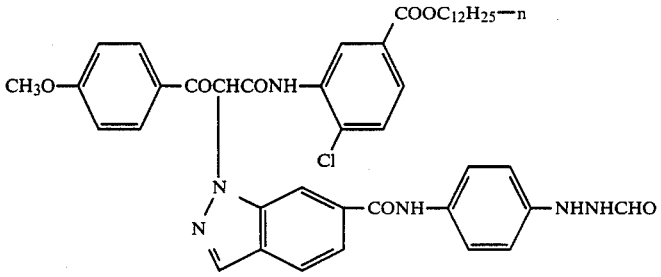
(I-24)
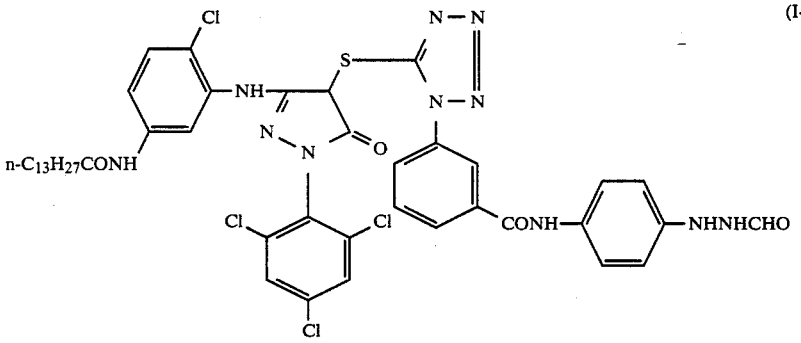
(I-25)
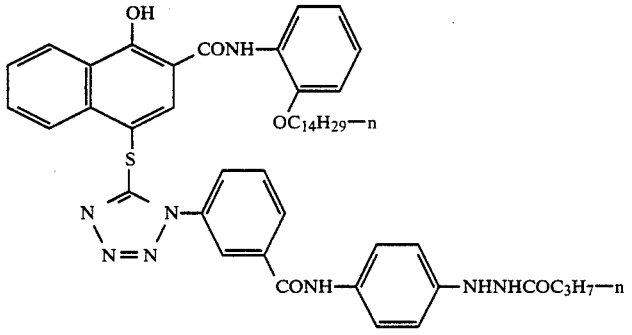

-continued
(I-26)
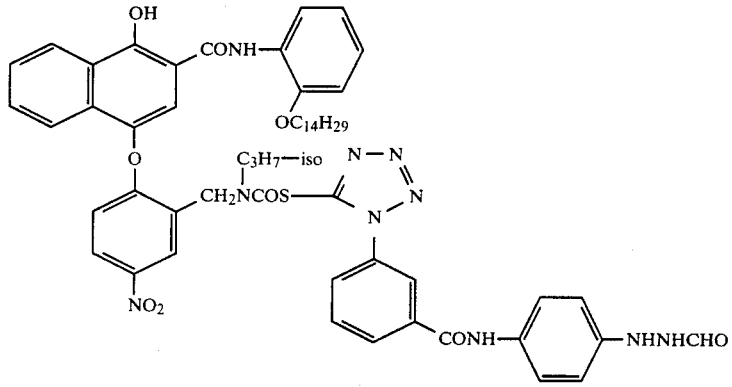
(I-27)
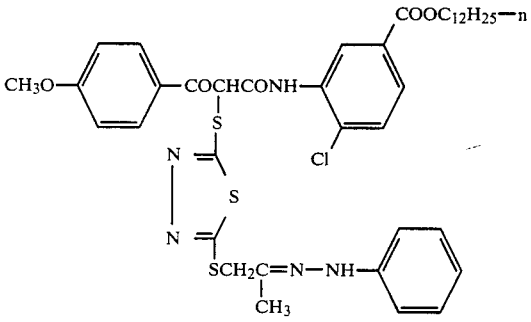
(I-28)
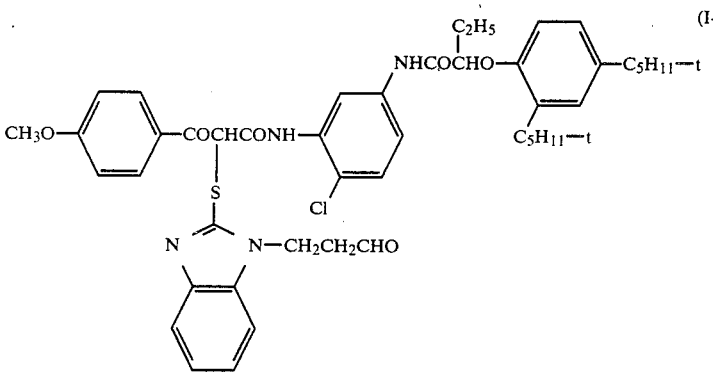
(I-29)
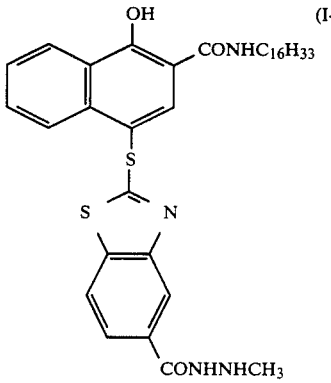
(I-30)
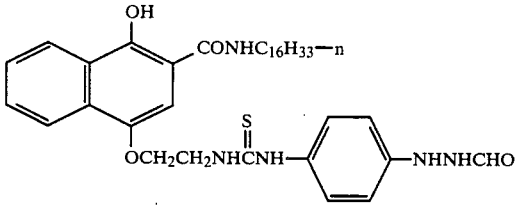
(I-31)
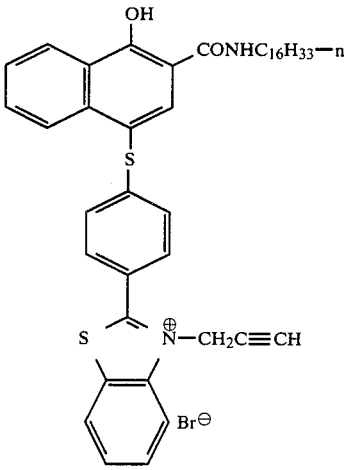

-continued
(I-32)
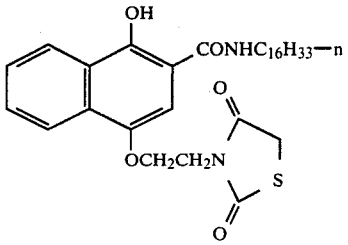
(I-33)
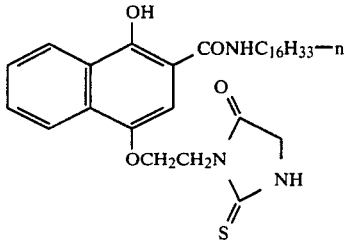
(I-34)
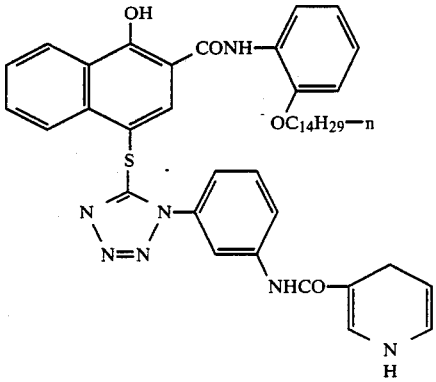
(I-35)
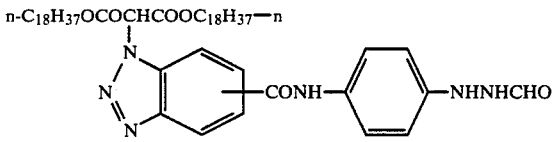
(I-36)
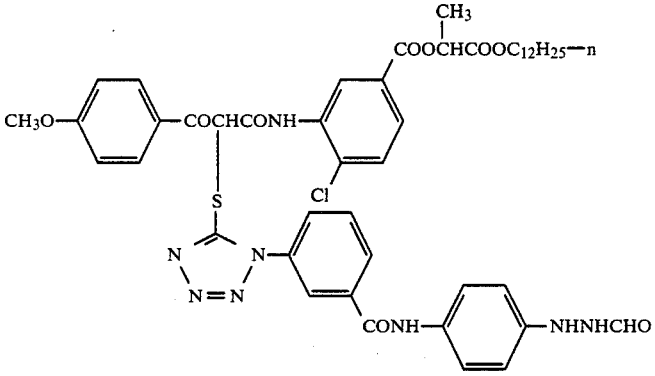
(I-37)
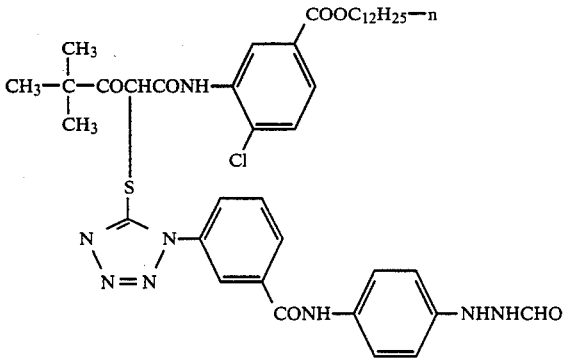

-continued (I-38)

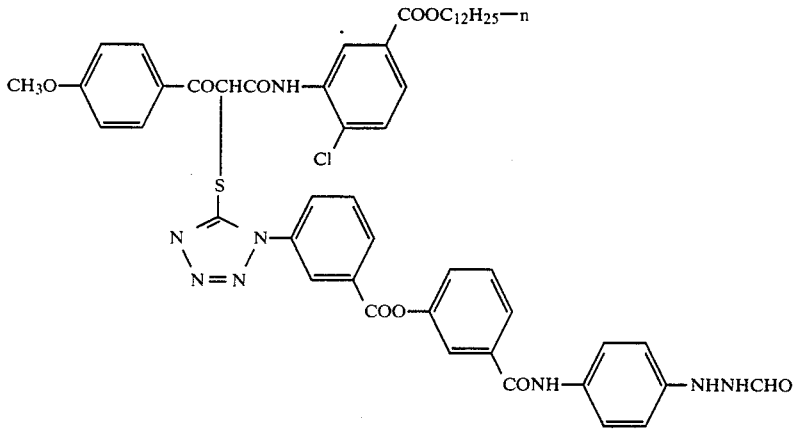

(I-39)

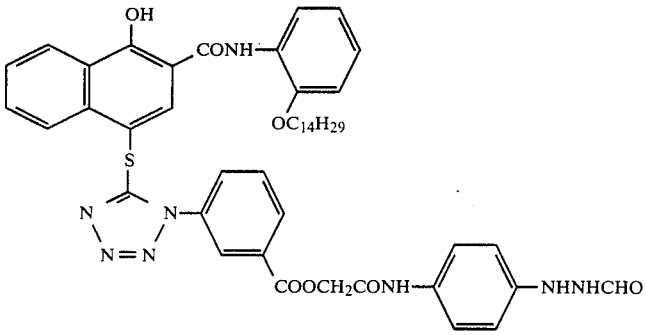

COUP-2 in the general formula (2) represents a group capable of causing a coupling reaction with an oxidation product of an aromatic primary amine developing agent, and BALL represents a group, called ballast group having such size and configuration as to confer sufficient non-diffusibility to coupler, attached to the coupling position of COUP-2 and capable of cleaving from COUP-2 by the reaction between COUP-2 and an oxidation product of an aromatic primary amine developing agent.

FOG represents a group exhibiting a fogging or development-accelerating effect in a developer after cleavage of BALL by the reaction with an oxidation product of an aromatic primary amine developing agent.

The coupler moiety represented by COUP-2 may be that which is known in the art or is being used.

A cyan coupler moiety includes a phenol coupler moiety, naphthol coupler moiety, etc. A magenta coupler moiety includes a 5-pyrazolone coupler moiety, a pyrazolobenzimidazole coupler moiety, a pyrazolotriazole coupler moiety, a cyanoacetylcoumarone coupler moiety, an open-chain acylacetanilide coupler moiety, etc. A yellow coupler moiety includes an acylacetanilide coupler moiety (e.g., a benzoylacetanilide coupler moiety, a pivaloylacetanilide coupler moiety, etc.), a malonedianilide coupler moiety, etc. As a colorless coupler moiety whose coupling product with an oxidation product of an aromatic primary amine developing agent do not have distinct visible absorption, there are illustrated open-chain or cyclic active methylene compounds (e.g., indanones, cyclopentanones, cyclohexanones, malonic diesters, acetophenones, imidazolones, oxazolones, thiazolones, etc.). However, the hue of the coupling product produced by the reaction between COUP-2 and oxidation product of an aromatic primary amine developing agent is not limited to the above-described hues, and may be any other hue.

The group represented by BALL, called ballast group, had such size and configuration as to confer sufficient nondiffusibility to the coupler, and may be of a polymer form wherein a plurality of coupling-off groups are attached to each other or may be a group which has an alkyl and/or aryl group conferring sufficient non-diffusibility. With the latter case, the alkyl and/or aryl group preferably contains totally about 8 to about 32 carbon atoms. BALL contains a linking group for attaching to the coupling position on COUP-2. Representative linking groups include oxy (—O—), thio (—S—), azo (—N=N—), carbonyloxy (—OCO—), sulfonyloxy (—$OSO_2$—), and imino $$(-\overset{|}{N}-)$$

constituting a hetero ring. As preferable BALL, there are illustrated alkoxy, aryloxy, heterocyclic oxy, alkylthio, arylthio, heterocyclic thio, arylazo, acyloxy, alkylsulfonyloxy, arylsulfonyloxy or hetero ring (e.g., pyrrole, pyrazole, imidazole, triazole, tetrazole, indole, indazole, benzimidazole, benzotriazole, phthalimide, succinimide, 2,4-imidazolidinedione, 2,4-oxazolidinedione, 2,4-thiazolidinedione, triazolidine-3,5-dione, etc.), having an alkyl and/or aryl group of 8 to 32 total carbon atoms.

FOG represents a group which constitute a part of a coupling product with a paper diffusibility produced by the reaction with an oxidation product of an aromatic primary amine developing agent, and which shows a fogging action in a developer. Specifically, FOG has a partial structure of a compound capable of forming silver sulfide (e.g., a reductive compound such as hydrazine, hydrazide, hydrazone, enamine, polyamine, hydroquinone, aminophenol, phenylenediamine, acetylene, aldehyde, etc. or a thiocarbonyl compound represented by thiourea, thioamide, thiocarbamate, dithiocarbamate, rhodamine, thiohydantoin, etc.) or of a quaternary salt compound represented by a tetrazolium salt, and contains a divalent group necessary to be attached to COUP-2.

The meaning of the term "proper diffusibility" as used herein varies depending upon the kind of light-sensitive material used but, for example with color negative-working films, it means such diffusibility that no serious reduction in sharpness or no serious influences (for example, increased contrast, etc.) on layers having different color sensitivities are caused.

In order to adjust diffusibility of the coupling product of the coupler in a silver halide emulsion layer or a gelatin layer, COUP-2 and/or FOG may have, as a substituent, a usually employed substituent or substituents having a suitable size and configuration (for example, an alkyl group, an alkoxy group, a halogen atom, a carbonamido group, a sulfonamido group, a carbamoyl group, a sulfamoyl group, a carboxy group, a sulfo group, a sulfonyl group, a hydroxy group, etc.) or a silver halide-adsorptive group (for example, an azole such as triazole, tetrazole, benzimidazole, indazole, benzotriazole, etc., a hetero ring containing hetero atom other than nitrogen atom in addition to nitrogen atom such as thiazole, thiadiazole, benzothiazole, benzoxazole, etc., a hetero ring having a mercapto group such as 2-mercaptobenzothiazole, 2-mercaptobenzoxazole, 2-mercapto-1,3,4-thiadiazole, 1-phenyl-5-mercaptotetrazole, etc., a quaternary salt such as a tetrazolium salt, a thiocarbonyl compound such as thiourea, thioamide, rhodanine, etc.).

Similarly with COUP-1, preferable examples of COUP-2 are represented by the general formulae (I) to (X).

In the general formulae (I) to (X) in the general formula (2),–Ẋ represents a position at which BALL is attached thereto. FOG is attached to COUP-2 at a position on $R_1$ to $R_{19}$, $Z_1$, $Z_2$ or $Z_3$ of the general formulae (I) to (X). The sum of the molecular weight of COUP-2 and that of FOG is preferably up to 500, more preferably up to 400.

Preferable examples of BALL include those which are represented by the following general formula (XI) to (XVII) in addition to an alkoxy group, an alkylthio group, and an acyloxy group:

(XI)

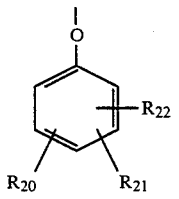

-continued (XII)

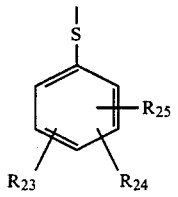

wherein $R_{20}$, $R_{21}$ and $R_{22}$ may be the same or different and each represents a hydrogen atom, a halogen atom, an alkyl group, an aryl group, an alkoxy group, an alkylthio group, a carbonamido group, a sulfonamido group, an acyl group, a sulfinyl group, a sulfonyl group, an alkoxycarbonyl group, an alkoxysulfonyl group, a carbamoyl group, a sulfamoyl group, a carboxy group, a sulfo group, a cyano group or a nitro group, and $R_{23}$, $R_{24}$, and $R_{25}$ may be the same or different and each represents a hydrogen atom, a halogen atom, an alkyl group, an aryl group, an alkoxy group, an alkylthio group, an acyl group, an acylamino group, an alkoxycarbonyl group or an aryloxy group:

(XIII)

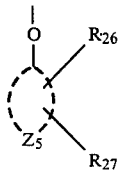

(XIV)

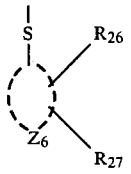

wherein $Z_5$ and $Z_6$ each represents non-metallic atoms necessary for forming a 5- to 7-membered ring (e.g., a triazole ring, a tetrazole ring, a thiadiazole ring, an oxadiazole ring, etc.), and $R_{26}$ and $R_{27}$ may be the same or different and each represents a hydrogen atom, a halogen atom, an alkyl group, an alkoxy group, an aryl group, an alkylthio group, an arylthio group, a carbonamido group or a sulfonamido group;

(XV)

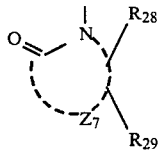

-continued (XVI)

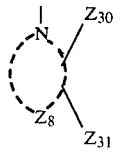

(XVII)

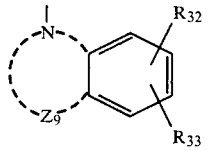

wherein $Z_7$ represents non-metallic atoms necessary for forming a 5- to 7-membered hetero ring (e.g., a hydantoin ring, an oxazolidinedione ring, a pyridone ring, etc.) together with

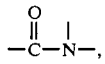

$Z_8$ represents non-metallic atoms necessary for forming an azole ring (e.g., pyrazole, imidazole, triazole, tetrazole, etc.) together with

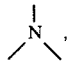

$Z_9$ represents non-metallic atoms necessary for forming an indole ring, an indazole ring, a benzimidazole ring or a benzotriazole ring together with

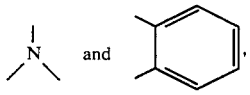

$R_{28}$ and $R_{29}$ may be the same or different and each represents a hydrogen atom, a halogen atom, an alkyl group, an aryl group, an alkoxy group, an aryloxy group, an alkylthio group, an arylthio group, an alkylamino group, a dialkylamino group, an anilino group, an alkoxycarbonyl group, a carbamoyl group, a sulfinyl group, a sulfonyl group, an acyloxy group, a carbonamido group or a sulfonamido group, $R_{30}$ and $R_{31}$ may be the same or different and each represents a hydrogen atom, a halogen atom, an alkyl group, an alkoxy group, an aryl group, an alkylthio group, an alkoxycarbonyl group, a carbamoyl group, a cyano group, an aryloxy group, a carbonamido group, a sulfonamido group or an ureido group, and $R_{32}$ and $R_{33}$ may be the same or different and each represents a hydrogen atom, a halogen atom, an alkyl group, an aryl group, an alkoxy group, an aryloxy group, an alkylthio group, an arylthio group, an alkoxycarbonyl group, an aryloxycarbonyl group, a carbamoyl group, a carbonamido group, a sulfonamido group, a sulfamoyl group or an ureido group.

In the general formulae (XI) to (XVII), the sum of the number of carbon atoms of each substituent ranges from 8 to 32, preferably 12 to 24.

In the general formula (2), preferable examples of FOG are those which have the partial structures represented by the following general formulae (XVIII) and (XIX):

(XVIII)

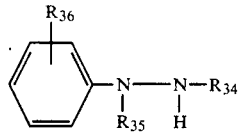

wherein $R_{34}$ represents an acyl group (e.g., a formyl group, an acetyl group, a trifluoroacetyl group, etc.), a sulfonyl group (e.g., a methanesulfonyl group, an ethanesulfonyl group, etc.) or an alkoxycarbonyl group (e.g., a methoxycarbonyl group), which each contains from 1 to 16 carbon atoms, preferably from 1 to 6 carbon atoms, $R_{35}$ represents a hydrogen atom, an alkoxycarbonyl group or an acyl group, which each contains from 2 to 12 carbon atoms, preferably from 2 to 6 carbon atoms, and $R_{36}$ represents a hydrogen atom, an alkyl group, an alkoxy group, a carbonamido group, a ureido group, an aryloxy group or a halogen atom, which each contains from 1 to 16 carbon atoms, preferably from 1 to 6 carbon atoms, with the group represented by the general formula of (XVIII) being attached to COUP-2 at a position on $R_{34}$, $R_{35}$, $R_{36}$ or phenyl ring via a divalent group (e.g, alkylene, alkenylene, arylene, —O—, —S—, carbonyl, sulfonyl, imino, etc.) or

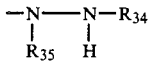

being directly attached to the aryl ring of COUP-2;

(XIX)

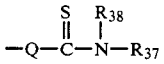

wherein

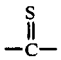

represents a thiocarbonyl group, $R_{37}$ and $R_{38}$ each represents independently a hydrogen atom, an alkyl group, an aryl group or an acyl group, Q represents alkylene, alkenylene, arylene, —O—, —S—, or

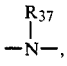

and

The sum of the number of carbon atoms of $R_{37}$, $R_{38}$ and Q ranges from 0 to 12, preferably from 1 to 8, with this group being attached to COUP-2 via a divalent group or directly as with the group of the general formula (XVIII).
Examples of the compounds of general formula (2) are illustrated below.
(II-1)
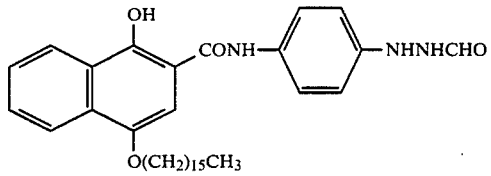
(II-2)
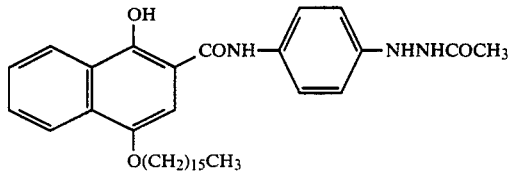
(II-3)
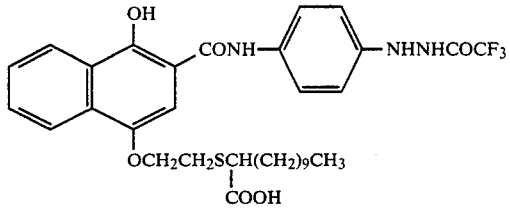
(II-4)
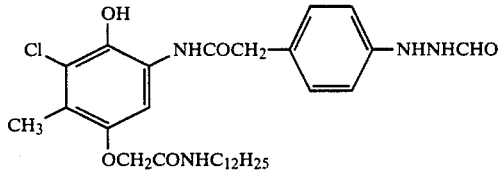
(II-5)
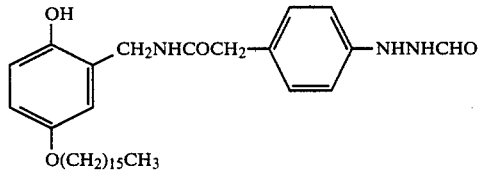
(II-6)
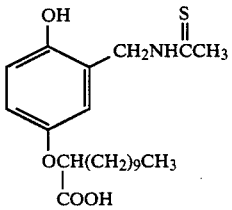
(II-7)
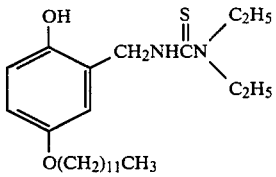

-continued
(II-8)
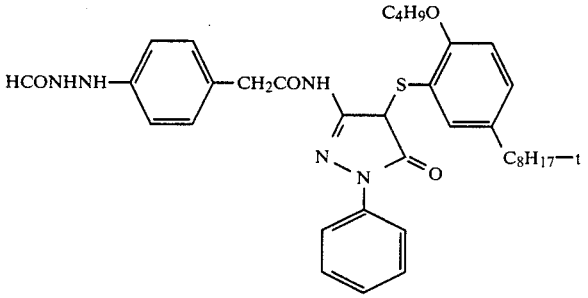
(II-9)
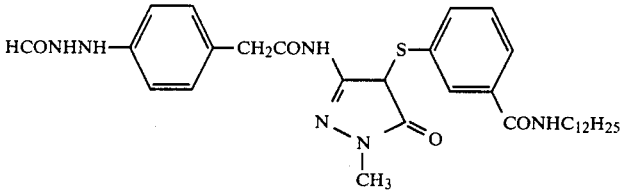
(II-10)
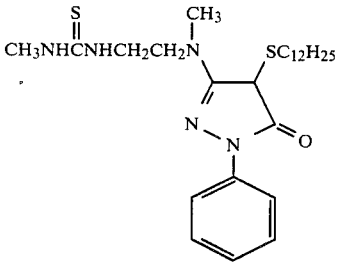
(II-11)
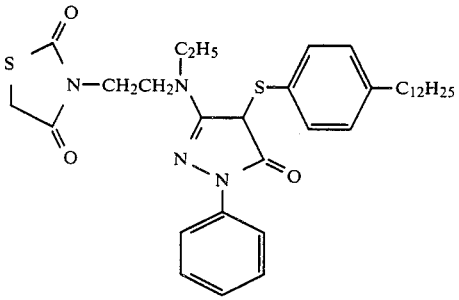
(II-12)
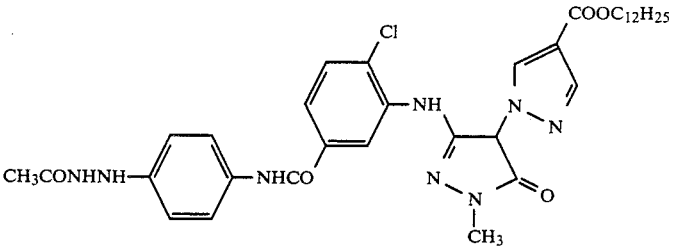
(II-13)
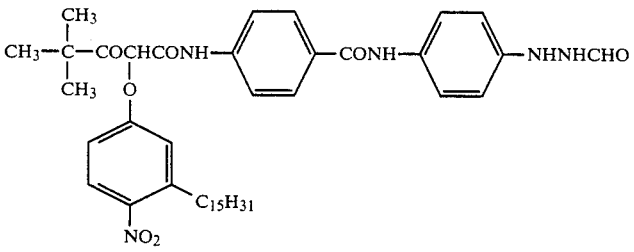

-continued
(II-14)
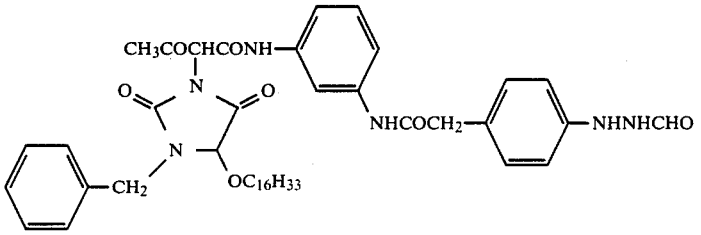
(II-15)
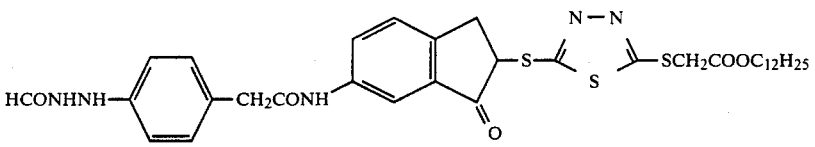
(II-16)
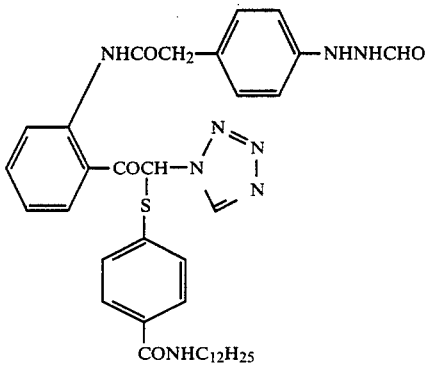
(II-17)
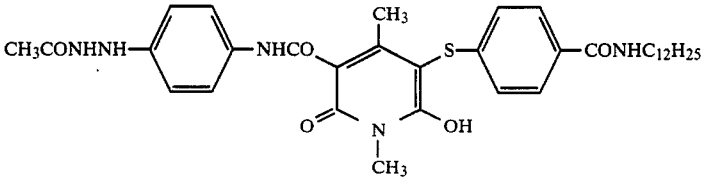
(II-18)
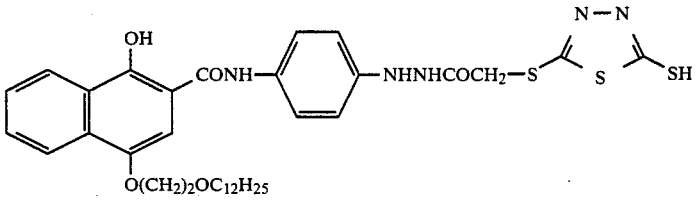
The compound of the general formula (3) to be used in the present invention, RED-W, is represented by the following general formulae (XX) to (XXV):
(XX)
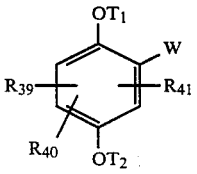
(XXI)
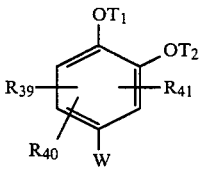
-continued
(XXII)
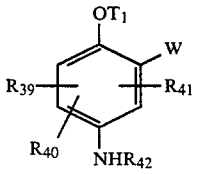
(XXIII)
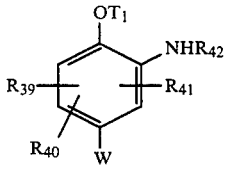

-continued (XXIV)

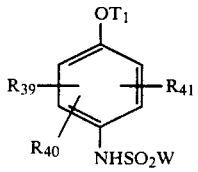

(XXV)

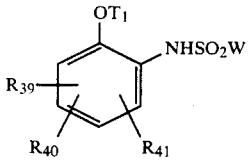

In the general formulae (XX) to (XXV), $R_{39}$, $R_{40}$, and $R_{41}$ may be the same or different and each represents a hydrogen atom, a halogen atom, an alkyl group, an aryl group, an alkoxy group, an aryloxy group, an alkylthio group, an arylthio group, a cyano group, an alkoxycarbonyl group, a carbamoyl group, a sulfamoyl group, a carboxy group, a sulfo group, a sulfonyl group, an acyl group, a cyano group, a carbonamido group, a sulfonamido group or a heterocyclic group, and The sum of the number of carbon atoms of $R_{39}$, $R_{40}$ and $R_{41}$ ranges from 0 to 40, preferably from 0 to 32, with $R_{39}$ and $R_{40}$ being optionally bound to each other to form a benzene ring or a 5- or 7-membered heterocyclic ring, $R_{42}$ represents an alkyl group, an aryl group, an acyl group, a carbamoyl group, a sulfonyl group or a sulfamoyl group, which each contains from 0 to 40 carbon atoms, preferably from 0 to 32 carbon atoms, $T_1$ and $T_2$ may be the same or different and each represents a group capable of being cleaved by hydrolysis under acidic or alkaline condition, W directly joined to a benzene ring [the general formulae (XX) to (XXIII)] represents a group which, after being cleaved, exhibits a fogging action in a developer, and W joined to a —$NHSO_2$— group [the general formulae (XXIV) and (XXV)] represents a group which, after being cleaved as W—$SO_2NH_2$ (or its anion), exhibits a fogging action in a developer.

As representative examples of $T_1$ and $T_2$, there are illustrated, in addition to a hydrogen atom, an acyl group (e.g., an acetyl group, a chloroacetyl group, a dichloroacetyl group, a trifluoroacetyl group, a benzoyl group, a p-nitrobenzoyl group, etc.), a sulfonyl group (e.g., a methanesulfonyl group, a benzenesulfonyl group, etc.), an alkoxycarbonyl group (e.g., a methoxycarbonyl group, a phenoxycarbonyl group, etc.), a carbamoyl group (e.g., an ethylcarbamoyl group, a phenylcarbamoyl group, etc.) , and an oxalyl group (e.g., a pyruvoyl group, a methoxalyl group, a phenyloxamoyl group, etc.), there are those represented by the following general formulae (XXVI), (XXVII), and (XXVIII):

(XXVI)

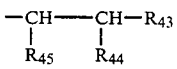

-continued (XXVII)

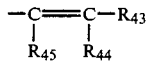

wherein $R_{43}$ represents an acyl group, a sulfonyl group, a cyano group, a carbamoyl group, a sulfamoyl group, an alkoxycarbonyl group, a nitro group, a carboxy group, a sulfo group, or an ammoniumyl group, $R_{44}$ and $R_{45}$ may be the same or different and each represents a hydrogen atom, an alkyl group or that referred to with respect to $R_{43}$, and The sum of the number of carbon atoms of $R_{43}$, $R_{44}$ and $R_{45}$ ranges from 1 to 24, preferably from 1 to 12, with $R_{43}$ and $R_{45}$ being optionally bound to each other to form a 5- to 7-membered ring; and (XXVIII)

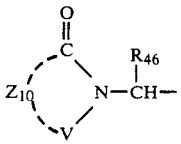

wherein $R_{46}$ represents a hydrogen atom, an alkyl group or an aryl group,

V represents

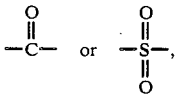

and $Z_{10}$ represents non-metallic atoms necessary for forming a 5- to 6-membered ring, and The sum of the number of carbon atoms of $R_{46}$ and $Z_{10}$ ranges from 1 to 24, preferably from 1 to 12.

Specific examples of the groups represented by the general formulae (XXVI), (XXVII), and (XXVIII) are illustrated below:

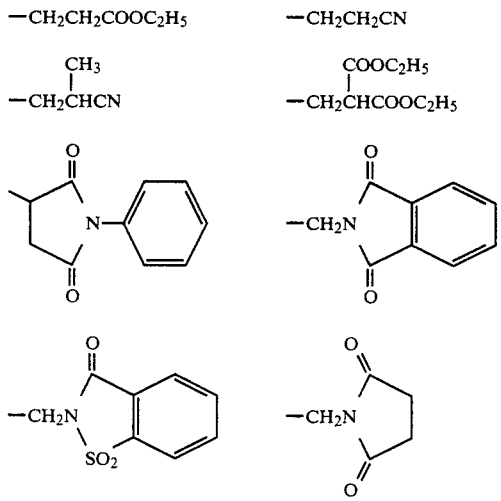

-continued

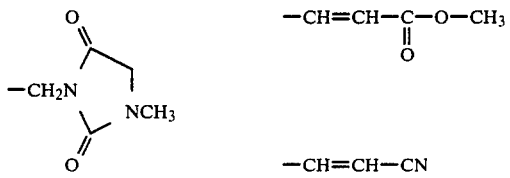

W preferably represents a group represented by the following general formula (XXIX):

$$\text{-(TIME-2)}_m\text{L}_1\text{-(L}_2\text{)}_k\text{W}_1 \qquad \text{(XXIX)}$$

wherein

TIME-2 represents a so-called timing group capable of releasing, after release of W, $—L_1—(L_2)_k—W_1$, m represents 0 or an integer of 1, $L_1$ represents, where l=0, a cleavable group for cleaving W by oxidation-reduction reaction between the compound of the general formula (XX) to (XXV) and an oxidation product of a developing agent under alkaline conditions or, when l=1, a group capable of being cleaved from TIME-2 of cleaved W.

Examples of TIME-2 include those which utilize intramolecular nucleophilic displacement reaction as described in U.S. Pat. No. 4,248,962, Japanese Patent Application (OPI) No. 56837/82, etc., those which utilize electron transfer via intramolecular conjugation system as described in Published Unexamined British Patent Application No. 2,072,363A, Japanese Patent Application (OPI) Nos. 154234/82 (corresponding to U.S. Pat. No. 4,421,845), 188035/82 and 98728/83, etc. TIME-2 includes those which involve multi-stage reactions.

Examples of $L_1$ include an aryloxy group, a heterocyclic oxy group, an arylthio group, a heterocyclic thio group, an azolyl group, etc. Specific examples of $L_1$ are illustrated below, in which asterisk (*) represents a binding position to -(TIME-2)$_m$-:

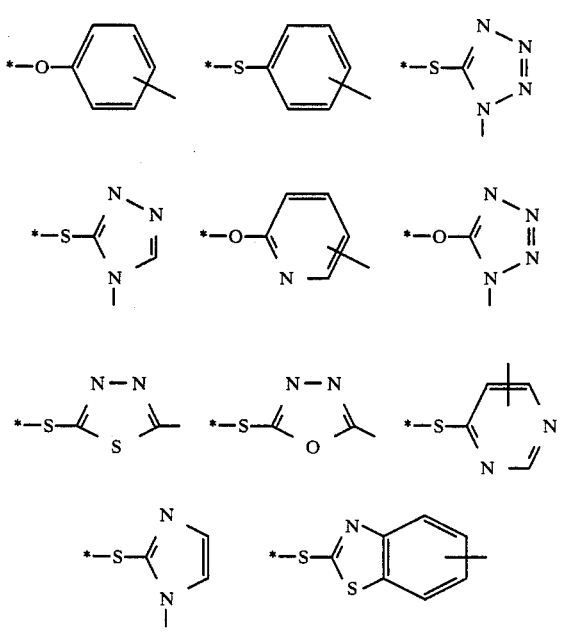

-continued

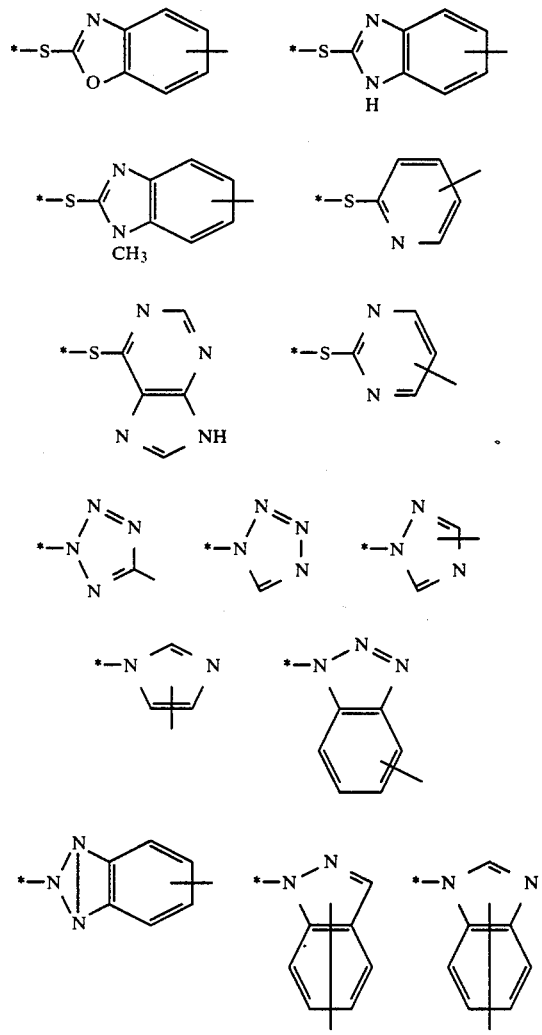

$L_2$ represents a divalent linking group, and k represents 0 or an integer of 1.

Examples of $L_2$ include alkylene, alkenylene, arylene, a divalent heterocyclic group, —O—, —S—, imino, —COO—, —CONH—, —NHCONH—, —NHCOO—, $—SO_2NH—$, —CO—, $—SO_2—$, —SO—, $—NHSO_2NH—$, etc. or a combination thereof.

$W_1$ represents a group which exhibits a substantial fogging effect on a silver halide emulsion when W exists in a developer in the form of W— or W—H. Specifically, there are illustrated reductive group (e.g., a group having a partial structure of hydrazine, hydrazide, hydrazone, hydroxylamine, polyamine, enamine, hydroquinone, catechol, p-aminophenol, o-aminophenol, aldehyde, acetylene, etc.), a group capable of acting on silver halide, upon development, to form developable silver sulfide nuclei (e.g., a group having a partial structure of thiourea, thioamide, thiocarbamate, dithiocarbamate, thiohydantoin, rhodamine, etc.), and a quaternary salt (e.g., a tetrazolium salt).

Of the groups represented by $W_1$ particularly useful groups are those which are represented by the following general formula (XXX):

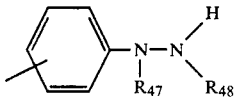

(XXX)

wherein $R_{47}$ represents a hydrogen atom or an alkoxycarbonyl group containing from 1 to 16 carbon atoms, preferably from 1 to 6 carbon atoms, and $R_{48}$ represents an acyl group, a sulfonyl group, a carbamoyl group, an alkoxycarbonyl group, a sulfamoyl group, a thioacyl group, a thiocarbamoyl group or a heterocyclic group, which each contains from 2 to 12 carbon atoms, preferably from 2 to 6 carbon atoms, with the benzene ring in the general formula (XXX) optionally overlapping with that of $L_1$ in the general formula (XXIX).

Specific examples of W are illustrated below.

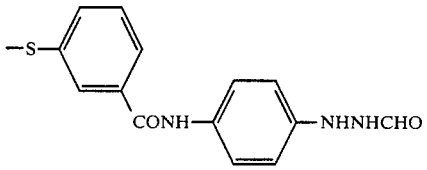

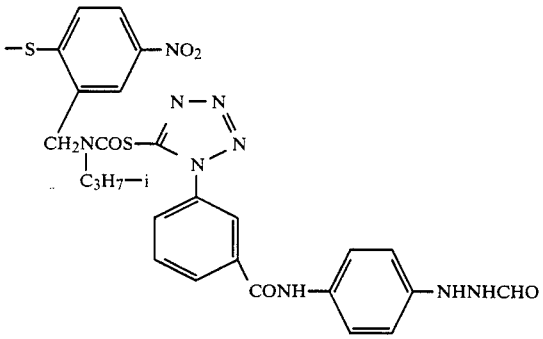

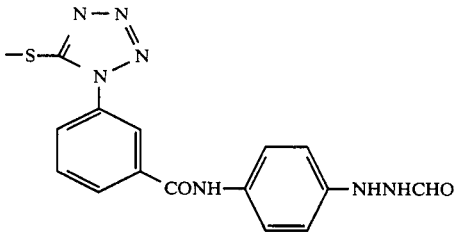

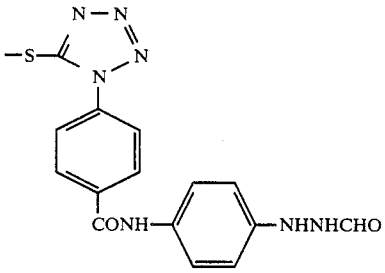

-continued

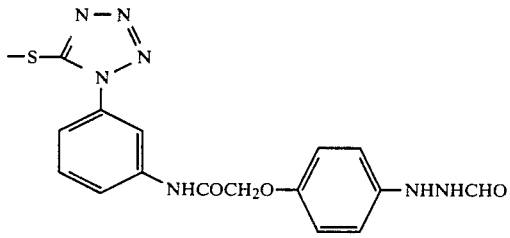

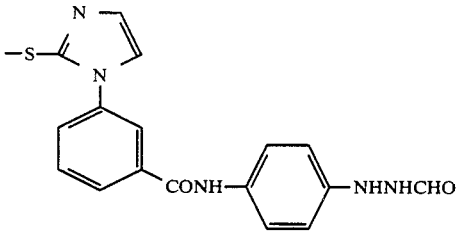

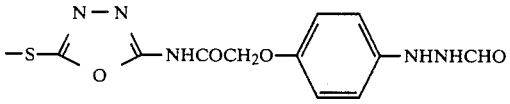

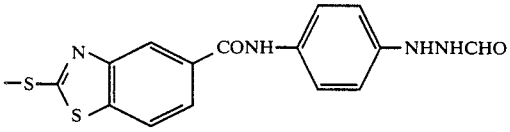

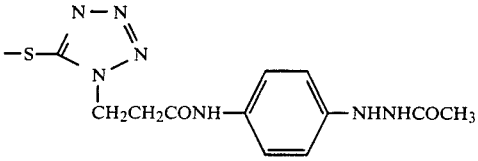

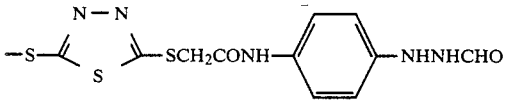

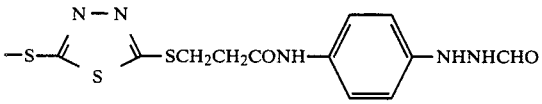

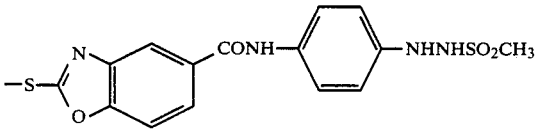

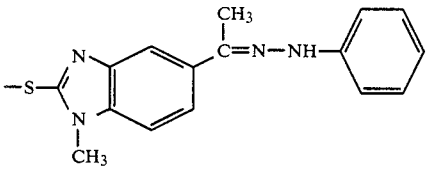

-continued
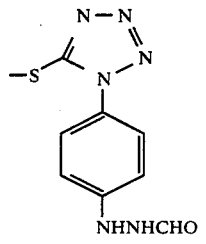
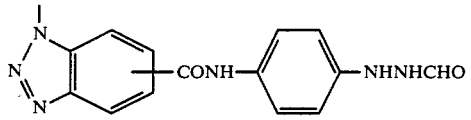
-continued
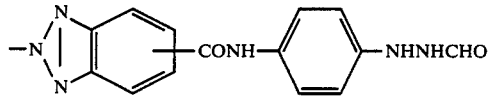
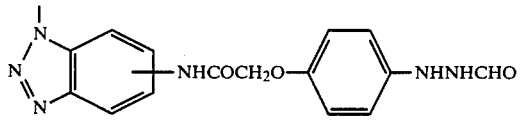
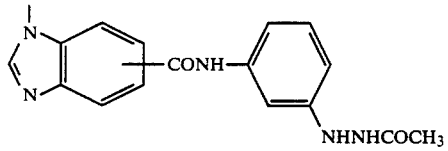
Examples of the compounds of the present invention are illustrated below.
III-1
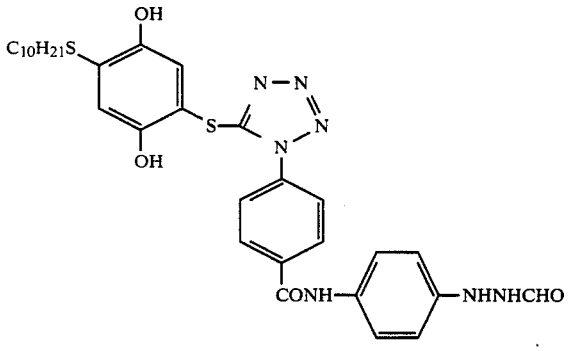
III-2
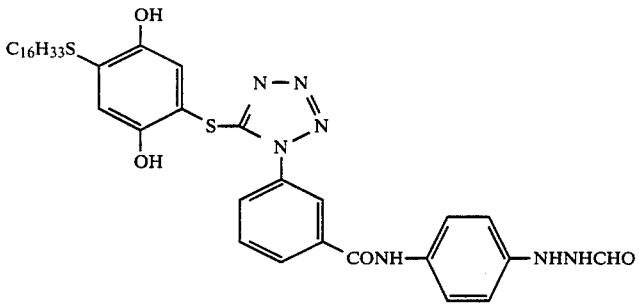
III-3
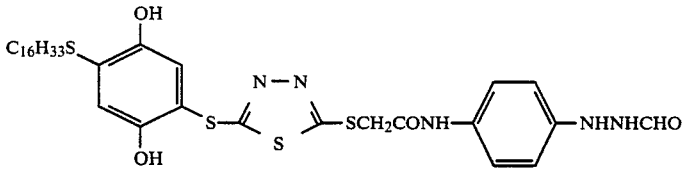
III-4
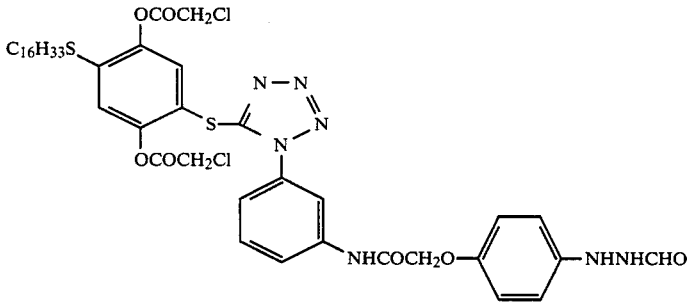

-continued
III-5
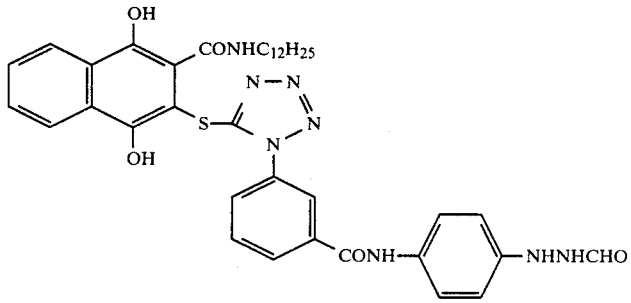
III-6
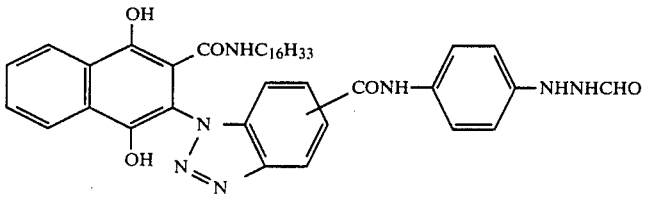
III-7
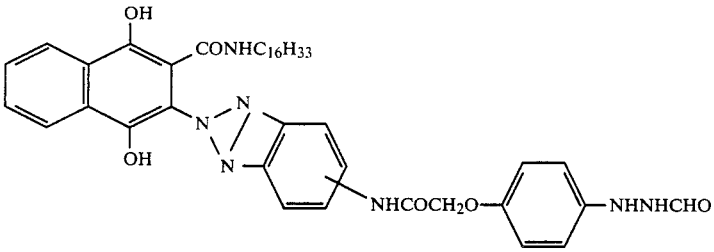
III-8
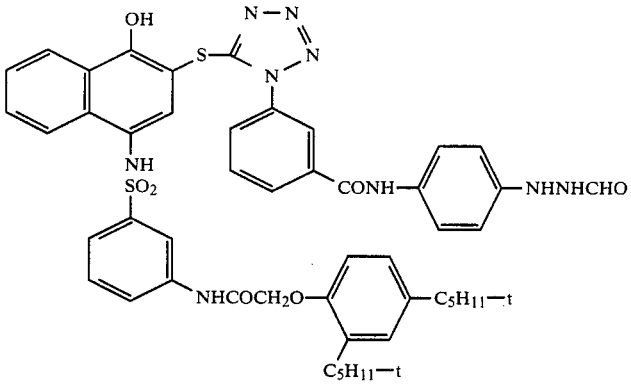
III-9
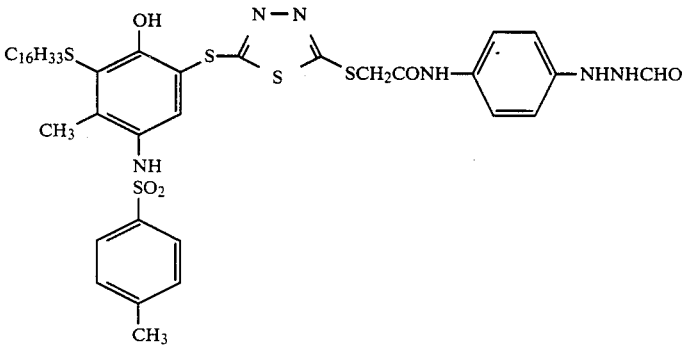

-continued
III-10
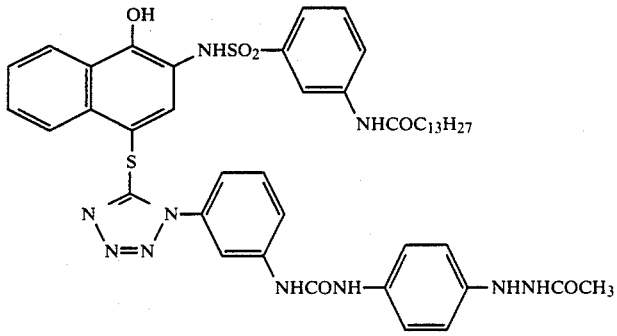
III-11
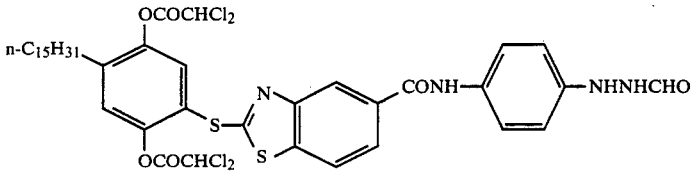
III-12
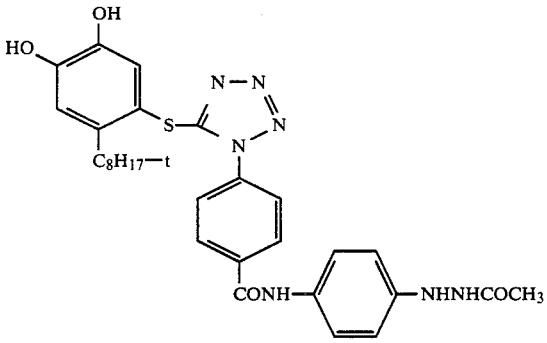
III-13
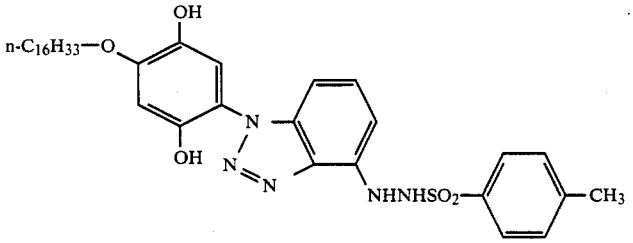
III-14
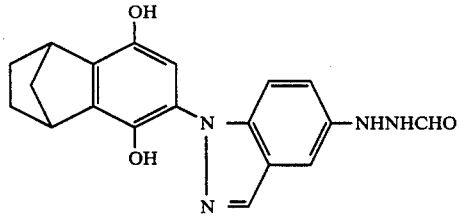
III-15
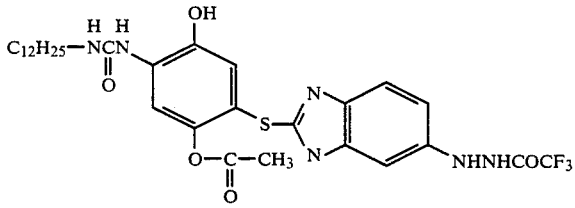

-continued

III-16

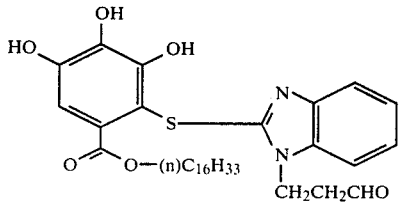

III-17

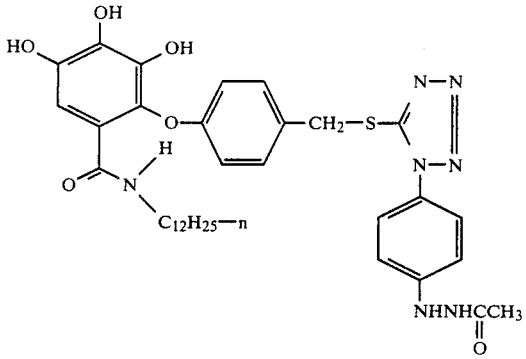

III-18

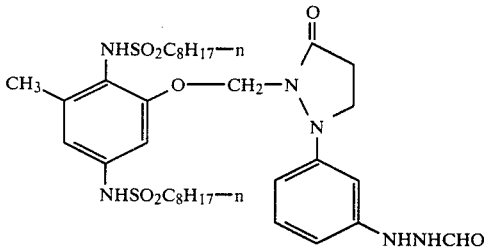

III-19

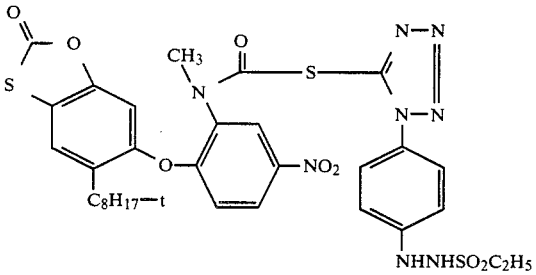

III-20

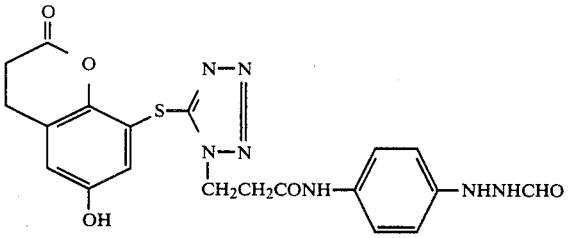

These FR compounds of the present invention may be generally synthesized from known compounds according to processes described in Japanese Patent Application (OPI) Nos. 150845/82, 138636/82, U.S. Pat. Nos. 3,214,377 and 3,253,924, Published Unexamined British Patent Application No. 2,131,188, etc.

The upper limit of the content of silver iodide of silver iodide-rich silver halide grains to be used in the present invention is determined by the solid solution limit, and is about 40 mol%. Therefore, in the present invention a silver halide emulsion having an average silver iodide content of about 8 mol% to about 40 mol%, preferably 10 to 30 mol%, more preferably 12 to 25 mol%, is used.

If the average silver iodide content is less than about 8 mol%, the effect of improving graininess, which is an object of the present invention, cannot be obtained in general. On the other hand, if more than about 40 mol%, development delay, reduction in contrast, insufficient removal of silver, or the like tends to take place.

The silver halide of the present invention having a high silver iodide content is not particularly limited as to the composition of other halides, but silver bromoiodide emulsions containing silver iodide in an amount falling within the above-described range are most preferable. As to the grain size, silver halide emulsions of the present invention having a high silver iodide content may have any grain size, with 0.8 μm or more, particularly 1.5 μm, being preferable.

The silver iodide contents of individual silver halide grains can be measured, for example, by using an X-ray microanalyzer, whereby the average silver iodide content can be determined.

The silver halide emulsion of the present invention having high silver iodide content may have a narrow or broad grain size distribution.

The silver halide grains in the photographic emulsion may be in a regular crystal form such as cubic, octahedral, dodecahederal or tetradecahedral form, in an irregular form such as spherical or tabular form, or in a mixed form thereof, or may comprise a mixture of particles in different forms.

In addition, emulsions in which super-tabular silver halide grains of 5 or more in diameter-to-thickness ratio account for 50% or more of the total grains based on the projected area of the grains may also be used.

The silver halide grains may have an inner portion and a surface layer different from each other in composition. For example, core/shell type grains comprising an internal portion (core) of silver, cholorobromoiodide or silver bromoiodide having a high content of silver iodide and an external portion (shell) of silver chlorobromoiodide or silver bromoiodide having a low content of silver iodide are particularly preferable for the practice of the present invention. The ratio of silver amount in the core portion to that in the shell portion can be selected from a wide range, with 5/1 to 1/5 being preferable. With such core/shell type grains, the requirement of the present invention for the iodide content is met as long as the iodide content in the core portion and that in the shell portion average 8 mol% or more. The core portion preferably has a silver iodide content of 15 mol% or more, particularly 25 mol% or more, more preferably 35 mol% or more, whereas the shell portion preferably has a silver iodide content of up to 5 mol%, particularly preferably up to 2 mol%.

The silver halide emulsion to be used in the present invention having a high silver iodide content can be prepared by various processes. That is, any of an acidic process, a neutral process and an ammoniacal process can be used. As a manner of reacting a soluble silver salt with a soluble halide salt, any of single jet process, double jet process, and their combination may be employed. As one embodiment of the double jet process, a process called controlled double jet process wherein pAg in a liquid phase in which silver halide is formed is kept constant can be employed.

As another embodiment of the double jet process, a triple jet process may be employed wherein soluble halide salts of different formulations are separately added (for example, soluble silver salt and soluble bromide salt and soluble iodide salt). In preparing comparatively large-size grains, the use of silver halide solvents such as ammonia, rhodanates, thioureas, amines, etc. (see, James; *The Theory of the Photographic Process,* 4th. ed., p. 9) is preferable.

It is well known in the art to obtain desired photographic properties by suitably adjusting pH and pAg during formation of grains. Upon formation of silver halide grains of the emulsion of the present invention, the pH may be varied in a range of from 2 to 10.

Two or more silver halide emulsions having been separately prepared may be mixed to use.

During formation or physical ripening of silver halide grains, cadmium salts, zinc salts, lead salts, thallium salts, iridium salts or the complex salts thereof, rhodium salts or the complex salts thereof, iron salts or the complex salts thereof, etc. may be allowed to coexist.

After the formation of the grains or after physical ripening, the soluble salts are usually removed from the emulsion. For this purpose, the well known noodle washing method in which gelatin is subjected to gelation may be used. Furthermore, a flocculation method which employs an inorganic salt having a polyvalent anion such as sodium sulfate, an anionic surface active agent, an anionic polymer (such as polystyrene sulfonic acid) or a gelatin derivative (such as an aliphatic acylated gelatin, an aromatic acylated gelatin or an aromatic carbamoylated gelatin) may be used.

As a binder or protective colloid to be used for emulsion layers or interlayers of the light-sensitive material of the present invention, gelatin is advantageously used. However, other hydrophilic colloids can be used as well.

For example, proteins such as gelatin derivatives, graft polymers of gelatin with other high molecular weight materials, albumin or casein, etc., cellulose derivatives such as hydroxyethylcellulose, carboxymethylcellulose or cellulose sulfate, etc., saccharide derivatives such as sodium alginate or starch derivatives, etc., and synthetic hydrophilic high molecular weight materials such as homo- or copolymers, for example, polyvinyl alcohol, partially acetalized polyvinyl alcohol, poly-N-vinylpyrrolidone, polyacrylic acid, polymethacrylic acid, polyacrylamide, polyvinylimidazole or polyvinylpyrazole, etc., can be used.

As gelatin, acid-processed gelatin or enzyme-processed gelatin as described in *Bull. Soc. Sci. Phot. Japan,* No. 16, p. 30 (1966) can be used in addition with lime-processed gelatin.

To the photographic emulsion to be used in the present invention may be incorporated various compounds for the purpose of preventing formation of fog or stabilizing photographic properties in the steps of producing, or during storage or processing of, light-sensitive materials. That is, compounds known a antifoggants or stabilizers such as azoles (e.g., benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly 1-phenyl-5-mercaptotetrazole), etc.); mercaptopyrimidines; mercaptotriazines; thioketo compounds such as oxazolinethione; azaindenes (e.g., triazaindenes, tetrazaindenes (particularly 4-hydroxy-substituted (1,3,3a,7)tetrazaindenes), pentazaindenes, etc.); benzenethiosulfonic acid, benzenesulfinic acid, benzenesulfonic acid amide, etc. can be added.

Detailed specific examples and the use thereof are described in, for example, U.S. Pat. Nos. 3,954,747 and 3,982,947, and Japanese Patent Publication No. 28660/77.

The light-sensitive material of the present invention may contain various known surface active agents for various purposes, e.g., as a coating aid, for preventing the generation of static charges, improving slip characteristics, improving emulsion dispersion, preventing adhesion, improving photographic characteristics (e.g., accelerating development, increasing contrast, sensitization), etc.

For example, nonionic surface active agents such as saponin (steroids), alkylene oxide derivatives (such as polyethylene glycol, polyethylene glycol/polypropylene glycol condensate, polyethylene glycol alkyl ethers or polyethylene glycol alkylaryl ethers, polyethylene glycol esters polyethylene glycol sorbitan esters, polyalkylene glycol alkylamine or amides, silicone polyethylene oxide adducts, etc.), glycidol derivatives (such as alkenylsuccinic acid polyglycerides or alkylphenol polyglycerides), aliphatic esters of polyvalent alcohols, alkyl esters of sucrose, etc.; anionic surface active agents containing an acidic group such as a carboxy group, a sulfo group, a sulfuric acid ester group or a phosphoric acid ester group, such as alkylcarboxylates, alkylsulfonates, alkylbenzenesulfonates, alkylnaphthalenesulfonates, alkylsulfates, alkylphosphates, N-acyl-N-alkyltaurines, sulfosuccinates, sulfoalkylpolyoxyethylene alkylphenyl ethers or polyoxyethylene alkylphosphates; amphoteric surface active agents such as amino acids, aminoalkylsulfonic acids, aminoalkylsulfuric acid esters, aminoalkylphosphoric acid esters, alkylbetaines, or amine oxides; and cationic surface active agents such as alkylamine salts, aliphatic or aromatic quaternary ammonium salts, hetero ring quaternary ammonium salts (such as pyridinium or imidazolium salts) or phosphonium or sulfonium salts containing an alicyclic or heterocyclic ring can be used.

The light-sensitive material of the present invention may contain a polyalkylene oxide or an ether, ester or amine derivative thereof, a thioether compound, a thiomorpholine compound, a quaternary ammonium salt compound, an urethane derivative, a urea derivative, an imidazole derivative, a 3-pyrazolidone compound, etc. for the purpose of enhancing sensitivity or contrast or for accelerating development. For example, those described in U.S. Pat. Nos. 2,400,532, 2,423,549, 2,716,062, 3,617,280, 3,772,021, and 3,808,003, British Patent No. 1,488,991, etc. can be used.

The photographic light-sensitive material of the present invention can contain a dispersion of a synthetic polymer which is insoluble or slightly soluble in water in its photographic emulsion layer or other hydrophilic colloidal layers for the purpose of improving the dimensional stability, or other purposes. Examples of polymers which can be used include polymers composed of one or more alkyl acrylates or methacrylates, alkoxyalkyl acrylates or methacrylates, glycidyl acrylates or methacrylates, acryl or methacrylamide, vinyl esters (for example, vinyl acetate), acrylonitrile, olefins and styrene, etc., and polymers comprising a combination of the above-described monomers and acrylic acid, methacrylic acid, $\alpha,\beta$-unsaturated dicarboxylic acids, hydroxyalkyl acrylates or methacrylates, sulfoalkyl acrylates or methacrylates, or styrene-sulfonic acid, etc.

The photographic light-sensitive material of the present invention may contain an organic or inorganic hardener in its photographic emulsion layers or other hydrophilic colloidal layers. For example, chromium salts (e.g., chromium alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (2,3-dihydroxydioxane, etc.), active vinyl compounds (e.g., 1,3,5-triacryloylhexahydro-s-triazine, 1,3-vinylsulfonyl-2-propanol, etc.), active halogen compounds (e.g., 2,4-dichloro-6-hydroxy-s-triazine, etc.), mucohalogenic acids (e.g., mucochloric acid, mucophenoxychloric acid, etc.), can be used alone or in combination.

In the light-sensitive material prepared by the present invention, dye or ultraviolet ray absorbents contained, if any, in its hydrophobic colloidal layers may be mordanted with a cationic polymer, etc. For example, polymers described in U.S. Pat. Nos. 2,675,316; 2,839,401, 2,882,156, 3,048,487, 3,184,309 and 3,445,231, West German Patent Application (OLS) No. 1,914,362, Japanese Patent Application (OPI) Nos. 47264/75 and 71332/75 (corresponding to U.S. Pat. No. 4,124,386), etc. may be used.

The photographic emulsions used in the present invention can be spectrally sensitized with methine or other dyes. Suitable sensitizing dyes include cyanine dyes, merocyanine dyes, complex cyanine dyes, complex merocyanine dyes, holopolar cyanine dyes, hemicyanine dyes, styryl dyes, and hemioxonol dyes. Particularly useful dyes are cyanine dyes, merocyanine dyes, and complex merocyanine dyes. These dyes can contain, as a basic heterocyclic nucleus, any of the nuclei which are usually employed in cyanine dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, and the like; nuclei as described above condensed with an alicyclic hydrocarbon rings; and nuclei as described above condensed with an aromatic hydrocarbon ring, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, and a quinoline nucleus. The carbon atoms of the above-described nuclei may be substituted.

The merocyanine dyes or complex merocyanine dyes can contain, as a nucleus having a ketomethylene structure, a 5- to 6-membered heterocyclic nucleus such as a pyrazolin-5-one nucleus, a thiohydantoin nucleus, a 2-thioxazolidin-2,4-dione nucleus, a thiazolidin-2,4-dione nucleus, a rhodanine nucleus or a thiobarbituric acid nucleus.

Useful sensitizing dyes are those described in, e.g., German Patent No. 929,080, U.S. Pat. Nos. 2,231,658, 2,493,748, 2,503,776, 2,519,001, 2,912,329, 3,656,959, 3,672,897, 3,694,217, 4,025,349, and 4,046,572, British Patent No. 1,242,588, Japanese Patent Publication Nos. 14030/69 and 24844/77, etc.

These sensitizing dyes may be used individually or as a combination thereof. A combination of sensitizing dyes is often employed particularly for the purpose of supersensitization. Typical examples of such combinations are described in, e.g., U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, 4,026,707, British Patent Nos. 1,344,281 and 1,507,803, Japanese Patent Publication Nos. 4936/68 and 12375/78, Japanese Patent Application (OPI) Nos. 110618/77 (corresponding to U.S. Pat. No. 4,152,163) and 109925/77, etc.

The sensitizing dyes may be present in the emulsion together with dyes which themselves do not give rise to any spectral sensitizing effects but exhibit a supersensitizing effect when used in combination or materials which do not substantially absorb visible light but exhibit a supersensitizing effect when use in combination. For example, aminostilbene compounds substituted with a nitrogen-containing heterocyclic ring (e.g., those described in U.S. Pat. Nos. 2,933,390 and 3,635,721), aromatic organic acid-formaldehyde condensate (e.g., those described in U.S. Pat. Nos. 3,743,510), cadmium salts, azaindene compounds, and the like can be present. The combinations described in U.S. Pat. Nos. 3,615,613, 3,615,641, 3,617,295, and 3,635,721 are particularly useful.

The present invention may also be applied to a multilayer, multicolor photographic material comprising a support having provided thereon at least two layers different from each other in spectral sensitivity. Multilayer, natural color photographic materials usually comprise a support having provided thereon at least one red-sensitive emulsion layer, at least one green-sensitive emulsion layer, and at least one blue-sensitive emulsion layer. The order of these layers may be optionally selected as the case demands. Each of the emulsion layer may be composed of two, three or more unit emulsions having different sensitivities. In such cases, the silver halide emulsion of the present invention having a high silver iodide content is usually used for a more sensitive unit emulsion layer.

In the photographic emulsion layers of the photographic light-sensitive material prepared by the present invention may be used dye-forming couplers, or compounds capable of forming color by oxidative coupling with an aromatic primary amine developing agent (e.g., a phenylenediamine derivative or an aminophenol derivative) in color development processing. For example, magenta couplers include 5-pyrazolone couplers, pyrazolobenzimidazole couplers, cyanoacetylcoumarone couplers, open-chain acylacetonitrile couplers, etc., yellow couplers include acylacetamide couplers, (e.g., benzoylacetanilides, pivaloylacetanilides, etc.), and cyan couplers include naphthol couplers and phenol couplers. Of these couplers, non-diffusible couplers having a hydrophobic group called ballast group or polymerized couplers are desirable. The couplers may be of either 4-equivalent type or 2-equivalent type based on silver ion. Colored couplers having color-correcting effect or couplers capable of releasing a development inhibitor upon development (called DIR couplers) may also be incorporated.

In addition to the DIR couplers, non-color forming DIR compounds capable of releasing a development inhibitor upon development and forming a colorless coupling reaction product may also be incorporated.

Furthermore, in addition to the DIR couplers, compounds capable of releasing a development inhibitor upon development may be incorporated in the light-sensitive material.

In order to obtain the characteristic properties required for a particular light-sensitive material, two or more of the above-described couplers, etc. may be used in combination in one and the same layer, or one and the same compounds may be incorporated in two or more different layers.

The photographic color couplers to be used are conveniently selected so as to obtain intermediate-scale images. Maximum absorption band of a cyan dye formed from the cyan coupler preferably lies between about 600 and about 720 nm, maximum absorption band of a magenta dye formed from the magenta coupler lies between about 500 and about 500 nm, and maximum absorption band of a yellow dye formed from the yellow coupler lies between about 400 and about 480 nm.

The couplers are introduced into silver halide emulsion layers in a known manner described in, for example, U.S. Pat. No. 2,322,027. For example, couplers are first dissolved in an alkyl phthalate (e.g., dibutyl phthalate, dioctyl phthalate, etc.), a phosphoric ester (e.g., diphenyl phosphate, triphenyl phosphate, tricresyl phosphate, dioctyl butyl phosphate, etc.), citric ester (e.g., tributyl acetylcitrate), a benzoic acid ester (e.g., octyl benzoate), an alkylamide (e.g., diethyllaurylamide), a fatty acid ester (e.g., dibutoxyethyl succinate, diethyl azelate, etc.), a trimesic acid ester (e.g., tributyl trimesate), etc. or in an organic solvent having a boiling point of about 30° to about 150° C. (e.g., a lower alkyl acetate such as ethyl acetate or butyl acetate, ethyl propionate, sec-butyl alcohol, methyl isobutyl ketone, β-ethoxyethyl acetate, methylcellosolve acetate, or the like), then dispersed in a hydrophilic colloid. The above-described high-boiling organic solvents and the low-boiling organic solvents may be used in combination.

In addition, a dispersing method using a polymer as described in Japanese Patent Publication No. 39853/76 and Japanese Patent Application (OPI) No. 59943/76 (corresponding to U.S. Pat. Nos. 4,214,067 and 4,304,769) may also be employed.

With couplers having an acid group such as a carboxylic acid or a sulfonic acid group, they are introduced into a hydrophilic colloid as an alkaline aqueous solution.

The light-sensitive material of the present invention may contain hydroquinone derivatives, aminophenol derivatives, gallic acid derivatives, ascorbic acid derivatives, etc. as color fog-preventing agents. Specific examples thereof are described in U.S. Pat. Nos. 2,360,290, 2,336,327, 2,403,721, 2,418,613, 2,675,314, 2,701,197, 2,704,713, 2,728,659, 2,732,300, 2,735,765, Japanese Patent Application (OPI) Nos. 92988/75, 92989/75, 93928/75, 110337/75 (corresponding to U.S. Pat. No. 3,982,944) and 146235/77 (corresponding to U.S. Pat. No. 4,232,114), Japanese Patent Publication No. 23813/75, etc.

The light-sensitive material prepared according to the present invention may contain in its hydrophilic colloidal layer an ultraviolet ray absorbent. For example, aryl group-substituted benzotriazole compounds (e.g., those described in U.S. Pat. No. 3,533,794), 4-thiazolidone compounds (e.g., those described in U.S. Pat. Nos. 3,314,794 and 3,352,681), benzophenone compounds (e.g., those described in Japanese Patent Application (OPI) No. 2784/71), cinnamic esters (e.g., those described in U.S. Pat. Nos. 3,705,805 and 3,707,375), butadiene compounds (e.g., those described in U.S. Pat. Nos. 4,045,229) or benzoxydol compounds (e.g., those described in U.S. Pat. No. 3,700,455) may be used. Further, those described in U.S. Pat. No. 3,499,762 and Japanese Patent Application (OPI) No. 48535/79 may also be used. Ultraviolet ray-absorbing couplers (e.g., α-naphtholic cyan dyeforming couplers) and ultraviolet ray-absorbing polymers may also be used. These ultraviolet ray-absorbents may be mordanted to a specific layer.

A water-soluble dye may be present in any of the hydrophilic colloid layers in the photographic light-sensitive material used in the present invention as a filter dye or for prevention or irradiation or various other purposes. Examples of these dyes include oxonol dyes, hemioxonol dyes, styryl dyes, merocyanine dyes, cyanine dyes and azo dyes. Of these dyes, oxonol dyes, hemioxonol dyes, and merocyanine dyes are particularly useful. Specific examples of dyes which can be used are those described in British Patent Nos. 584,609 and 1,177,429, Japanese Patent application (OPI) Nos. 85130/73, 99620/74, 114420/74 and 108115/77, U.S. Pat. Nos. 2,274,782, 2,533,472, 2,956,879, 3,148,187, 3,177,078, 3,247,127, 3,540,887, 3,575,704, 3,653,905, 3,718,472, 4,071,312 and 4,070,352.

In the practice of the present invention, the following known fading-preventing agents can be used in combination. The color image-stabilizing agents to be used in the present invention may be used alone or in combination of two or more. The known fading-preventing agents include, for example, hydroquinone derivatives, gallic acid derivatives, p-alkoxyphenols, p-hydroxyphenol derivatives, bisphenols, and the like.

Specific examples of the hydroquinone derivatives are described in U.S. Pat. Nos. 2,360,290, 2,418,613, 2,675,314, 2,701,197, 2,704,713, 2,728,659, 2,732,300, 2,735,765, 2,710,801, 2,816,028, British Patent No. 1,363,921, etc., specific examples of the gallic acid derivatives are described in U.S. Pat. Nos. 3,457,079 and 3,069,262, specific examples of p-alkoxyphenols are described in U.S. Pat. Nos. 2,735,765 and 3,698,909, Japanese Patent Publication Nos. 20977/74 (corresponding to U.S. Pat. No. 3,064,337) and 6623/77, specific examples of the p-hydroxyphenol derivatives are described in U.S. Pat. Nos. 3,432,300, 3,573,050, 3,574,627 and 3,764,337, Japanese Patent Application (OPI) Nos. 35633/77, 147434/77 and 152225/77 (corresponding to U.S. Pat. No. 4,113,495), and specific examples of bisphenols are described in U.S. Pat. No. 3,700,455.

In photographic processing of the layers composed of the photographic emulsion of the present invention, any of known processes and known processing solutions described in, for example *Research Disclosure* 176, 28–30 may be employed. Such processing may be a photographic processing for forming a silver image or a color photographic processing for forming a dye image (color photographic processing) depending upon the purpose. The processing temperature is usually selected between 18° and 50° C. However, temperatures lower than 18° C. or higher than 50° C. may be employed.

As a special type development processing, a developing agent may be incorporated in a light-sensitive material, for example, in an emulsion layer, the resulting light-sensitive material being processed in an alkaline aqueous solution to develop. Of the developing agents, hydrophobic ones can be incorporated in an emulsion layer according to various techniques described in *Research Disclosure* No. 169 (16928), U.S. Pat. No. 2,739,890, British Patent No. 813,253, West German Patent No. 1,547,763, etc. Such development processing may be combined with a processing of stabilizing silver salt with a thiocyanate.

As a fixing solution, those which have the same formulation as are ordinary employed can be used. As a fixing agent, organic sulfur compounds which are known to function as fixing agents can be used as well as thiosulfates and thiocyanates. The fixing solution may contain a water-soluble aluminum salt as a hardener.

When a dye image is formed according to the present invention, the conventional process, for example, a negaposi process (which is described in, for example, *Journal of the Society of Motion Picture and Television Engineers,* Vol. 61 (1953), 667–701) or etc. can be employed.

When the color light-sensitive material of the present invention is adapted to be used as color negative-working film, color positive-working film or color paper, it is subjected to the following processing after imagewise exposure.

Where a persulfate is used, the exposed light-sensitive material is usually subjected to processing (1) fundamentally comprising: color development→stopping→washing with water→bleaching-accelerating bath→bleaching with a persulfate→washing with water→fixing→washing with water→stabilizing→drying. In processing (1), a pre-bath, a hardening bath, etc. may be provided before color development step, and washing with water step after stopping, bleaching-accelerating bath or bleaching with a persulfate may be eliminated. Also, the bleaching-accelerating bath may be eliminated.

Where a ferric ion complex salt is used, the exposed light-sensitive material is usually subjected to processing (2) fundamentally comprising: color development→bleaching with a ferric ion complex salt→washing with water→fixing→washing with water→stabilizing→drying. In processing (2), washing with water step after bleaching may be eliminated. Further, a simple and convenient processing of conducting the stabilizing step substantially without washing with water after the fixing step may also be employed. In addition, the bleaching→washing with water→fixing steps may be conducted by a mono-bath bleaching-fixing processing.

On the other hand, when the light-sensitive material is used as color reversal film, it is usually subjected to processing (3) fundamentally comprising: black-and-white development→stopping→washing with water→fogging→washing with water→color development→stopping→washing with water→bleaching-accelerating bath→washing with water→bleaching with a persulfate or ferric ion complex salt→washing with water→fixing→washing with water→stabilizing→drying. In processing (3), a pre-bath, a pre-hardening bath, a neutralizing bath, etc. may be provided. The washing with water step after the stopping step, fogging step, bleaching-accelerating step, or bleaching step may be eliminated. The fogging bath may be replaced by re-exposure, or may be eliminated by adding the fogging agent to a color-developing bath. Further, the bleaching-accelerating bath may be eliminated. The bleaching→washing with water→fixing steps may be conducted in a mono-bath blix solution.

Color developers generally comprise an alkaline aqueous solution containing a color developing agent. As the color developing agent, known primary aromatic amine developing agents may be used such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfoamidoethylaniline, 4-amino-3-methyl-N-ethyl-N-β-methoxyethylaniline, etc.).

In addition, those described in L. F. A. Mason; *Photographic Processing Chemistry* (Focal Press, 1966), pp. 226–229, U.S. Pat. Nos. 2,193,015 and 2,592,364, Japanese Patent Application (OPI) No. 64933/73 (corresponding to U.S. Pat. No. 3,816,134), etc. may also be used.

The color developer may further contain pH buffers such as alkali metal sulfites, carbonates, borates, and phosphates, development inhibitors or antifoggants such as bromides, iodides and organic antifoggants and, if necessary, may contain water softeners, preservatives such as hydroxylamine, organic solvents such as benzyl alcohol and diethylene glycol, development accelerators such as polyethylene glycol, quaternary ammonium salts, and amines, dyeforming couplers, competitive couplers, fogging agents such as sodium borohydride, auxiliary developing agents such as 1-phenyl-3-pyrazolidone, viscosity-imparting agents, polycarboxylic acid type chelating agents described in U.S. Pat. No. 4,083,723, antioxidants described in West German Patent Application (OLS) No. 2,622,950, and the like.

In the bleaching solution or bleach-fixing solution of the present invention, a bleaching agent with weak bleaching power is used. A ferric ion complex, one of the bleaching agents, is a complex of ferric ion and a chelating agent such as aminopolycarboxylic acid, aminopolyphosphoric acid or the salt thereof. Aminopolycarboxylic acid salts or aminopolyphosphoric acid salts are alkali metal salts, ammonium salts or water-soluble amine salts thereof. The alkali metals include sodium, potassium, lithium, etc., and water-soluble amines include alkylamines (e.g, methylamine, diethylamine, triethylamine, butylamine, etc.), alicyclic amines (e.g., cyclohexylamine), arylamines (e.g., aniline, m-toluidine, etc.), and heterocyclic amines (e.g., pyridine, morpholine, piperidine, etc.).

Typical examples of the chelating agents of these aminopolycarboxylic acids, aminopolyphosphoric acids, and the salts thereof are:

ethylenediaminetetraacetic acid;
disodium ethylenediaminetetraacetate;
diammonium ethylenediaminetetraacetate;
tetra(trimethylammonium) ethylenediaminetetraacetate;
tetrapotassium ethylenediaminetetraacetate;
tetrasodium ethylenediaminetetraacetate;
trisodium ethylenediaminetetraacetate;
diethylenetriaminepentaacetic acid;
pentasodium diethylenetriaminepentaacetate;
ethylenediamine-N-(β-hydroxyethyl)-N,N',N'-triacetic acid;
trisodium ethylenediamine-N-(β-hydroxyethyl)-N,N',N'-triacetate;
triammonium ethylenediamine-N-(β-hydroxyethyl)-N,N',N'-triacetate;
propylenediaminetetraacetic acid;
disodium propylenediaminetetraacetate;
nitrilotriacetic acid;
trisodium nitrilotriacetate;
cyclohexanediaminetetraacetic acid;
disodium cyclohexanediaminetetraacetate;
iminodiacetic acid;
dihydroxyethylglycine;
ethyl ether diaminetetraacetic acid;
glycol ether diaminetetraacetic acid;
ethylenediaminetetrapropionic acid;
phenylenediaminetetraacetic acid;
1,3-diaminopropanol-N,N,N',N'-tetramethylenephosphonic acid;
ethylenediamine-N,N,N',N'-tetramethylenephosphonic acid;
1,3-propylenediamine-N,N,N',N'-tetramethylenephosphonic acid;
and the like.

Needless to say, the above-illustrated compounds do not limit the chelating agents at all.

The ferric ion complex salts may be used in the form of complex salt or may be formed in situ in a solution by using a ferric salt (e.g., ferric sulfate, ferric chloride, ferric nitrate, ferric ammonium sulfate or ferric phosphate) and a chelating agent (e.g., aminopolycarboxylic acid, aminopolyphosphoric acid or phosphonocarboxylic acid). When they are used in the form of a complex salt, they may be used alone or in combination of two or more. On the other hand, where a complex salt is formed in situ in a solution by using a ferric salt and a chelating agent, one, two or more ferric salts may be used. Further, one, two or more chelating agents may also be used. In every case, a chelating agent may be used in an amount more than is necessary for forming a ferric ion complex salt.

A bleaching or bleach-fixing solution containing the above-described ferric ion complex may further contain complexes of other metals than iron such as cobalt or copper or hydrogen peroxide.

Persulfates to be used in the bleaching or bleach-fixing solution of the present invention are alkali metal persulfates such as potassium persulfate, sodium persulfate, etc., and ammonium persulfate. Bleaching agents with a weak bleaching power are used in the present invention, with persulfates providing remarkable effects.

These bleaching agents are used in amounts of preferably 0.05 to 2 mols per liter of the bleaching solution.

The bleaching solution may contain a chloride (e.g., potassium chloride, sodium chloride, ammonium chloride, etc.) or a bromide (e.g., potassium bromide, sodium bromide, ammonium bromide, etc.). However, in the case of using persulfates, bromides are difficulty used because a bromine gas is to be produced. These halides are used in amounts of preferably 0.1 to 2 mols per liter of the bleaching solution. Further, the bleaching solution may contain one or more inorganic or organic acids with a buffering ability (e.g., boric acid, borax, sodium metaborate, acetic acid, sodium acetate, sodium carbonate, potassium carbonate, phosphorous acid, phosphoric acid, sodium phosphate, citric acid, sodium citrate, tartaric acid, etc.) or the salts thereof. Still further, such salts as sodium sulfate, potassium sulfate, etc. may be added to the bleaching solution to adjust the salt concentration.

To the bleaching solution containing a persulfate may be added an imide compound described in Japanese Patent Application (OPI) No. 149944/80 in an amount of $2\times10^{-6}$ to $1\times10^{-1}$ mol, preferably $1\times10^{\times10-2}$ to $4\times10^{-2}$ mol, per liter of the solution for preventing production of a halogen gas.

The pH of the bleaching solution is desirably in a range of from 1.0 to 8.0, particularly 1.5 to 7.5, upon use.

In addition, various bleaching-accelerating agents may be used in a bleaching solution, a bleach-fixing solution or a pre-bath solution thereof. For example, bleaching-accelerating agents such as mercapto compounds and dithiocarbamate compounds described in U.S. Pat. No. 3,707,374, Japanese Patent Publication No. 28227/76 (corresponding to U.S. Pat. No. 3,870,520), Japanese Patent Application (OPI) Nos. 94927/78 (corresponding to U.S. Pat. No. 4,144,068), 95631/78, 97980/78, and 98901/78 may be used.

On the other hand, in using the composition of the present invention as a bleach-fixing agent, ordinary fixing agents, i.e., water-soluble, silver halide-dissolving agents such as thiosulfates (e.g., sodium thiosulfate, ammonium thiosulfate, ammonium sodium thiosulfate, potassium thiosulfate, etc.); thiocyanates (e.g., sodium thiocyanate, ammonium thiocyanate, potassium thiocyanate, etc.); thioether compounds (e.g., ethylene-bis(thioglycolic acid), 3,6-dithia-1,8-octanediol, etc.); and thioureas are used alone or in combination of two or more. In addition, special bleach-fixing agents comprising a combination of a fixing agent described in Japanese Patent Application (OPI) No. 155354/80 and a large amount of a halide compound such as potassium iodide can be used as well.

In the bleach-fixing composition, the amount of ferric ion complex salt is 0.1 to 2 mols and the amount of fixing agent is 0.2 to 4 mols, per liter of the bleach-fixing solution.

A bleach-fixing solution can contain the aforesaid additives to be added to the bleaching solution and preservatives such as sulfites (e.g., sodium sulfite potassium sulfite, ammonium sulfite, etc.), hydroxylamine, hydrazine, aldehyde-bisulfite adducts (e.g., acetaldehydesodium bisulfite adduct), etc. Further, various fluorescent brightening agents, defoaming agents, surfactants, organic solvents (e.g., methanol), and known blix-accelerating agents (e.g., polyamine compounds described in Japanese Patent Publication No. 8836/70 (corresponding to U.S. Pat. No. 3,578,454), thiourea derivatives described in Japanese Patent Publication No. 8506 (corresponding to U.S. Pat. No. 3,617,283), iodides described in German Patent No. 1,127,715, polyethylene oxides described in German Patent No. 966,410, nitrogen-containing hetero ring compounds described in German Patent No. 1,290,812, and other thioureas) may be used. The pH of the bleach-fixing solution upon use is usually 4.0 to 9.0, particularly preferably 5.0 to 8.0.

The photographic light-sensitive material of the present invention can be used as ordinary silver halide color light-sensitive materials such as color negative-working films, color papers, color positive-working films, color reversal films for slides, color reversal cinema films, color reversal TV films, etc., and is particularly useful for color negative-working films and color reversal films required to possess high sensitivity and high image quality. Further, the present invention can be applied to black-and-white light-sensitive materials, and is particularly usefully applied to high-speed black-and-white photographing materials since it enables rapid processing with high sensitivity.

The present invention can be applied to black color-forming coupler system described in U.S. Pat. Nos. 3,622,629, 3,734,735 and 4,126,461, Japanese Patent Application (OPI) Nos. 105247/80, 42725/77 (corresponding to U.S. Pat. No. 4,200,466), and 105248/80 (corresponding to U.S. Pat. No. 4,254,213), etc., three-color couplers-mixing system described in *Research Disclosure,* 17123, etc. When utilized for, for example, X-ray films, these systems enable to save coated silver, accelerate photographic processing, and reduce the irradiation amount usually accompanying improvement of sensitivity, etc.

In addition, since the photographic light-sensitive material of the present invention can rapidly form a contrasty image, it is also useful as a light-sensitive material for use in photomechanical process.

In applying the present invention to monochromatic photographic light-sensitive materials, color development processing of p-phenylenediamine type or ordinary black-and-white development processing using the FR compound of the present invention of the general formula (3) functioning in oxidation-reduction reaction may be conducted.

The present invention is now illustrated in more detail by reference to the following examples which, however, are not to be construed as limiting the present invention in any way.

EXAMPLE 1

Preparation of Emulsion A 800 ml of an aqueous solution containing 0.33 mol of silver nitrate was added to 1,000 mol of a 2% gelatin aqueous solution containing 0.41 mol of potassium bromide and 0.06 mol of potassium iodide stirred at 60° C. over a 20-minute period. After physical ripening for 20 minutes, 1,000 ml of an aqueous solution containing 0.67 mol of silver nitrate and an aqueous solution containing 0.67 mol/liter of potassium bromide were simultaneously added thereto over a 50-minute period, during which period the pAg was maintained at 8.6. After washing with water in a conventional manner, $2\times10^{-5}$ mol of thiosulfate and $4\times10^{-5}$ mol of chloroauric acid were added thereto to chemically sensitize at 60° C. for 60 minutes. Thus, a silver bromoiodide emulsion (Emulsion A) having a mean grain size of 1.1 μm and an iodide content of 6 mol% was obtained.

Preparation of Emulsion B

In the same manner as with Emulsion A except for using a 2% gelatin aqueous solution containing 0.37 mol of potassium bromide and 0.10 mol of potassium iodide, there was obtained a silver bromoiodide emulsion (Emulsion B) containing 10 mol% silver iodide and having an average grain size of 1.0 μm.

Emulsion A or B was mixed with an emulsion prepared by dissolving the following magenta coupler, $MC_p1$, in tricresyl phosphate and ethyl acetate, followed by emulsification, was coated on a subbed triacetyl cellulose film to prepare Samples 101 to 110 as follows.

Sample 101

(1) Emulsion layer
Emulsion A . . . amount of coated Ag: 1.8 g/m$^2$
Magenta coupling $MC_p1$: 0.9 g/m$^2$
Tricresyl phosphate: 1.8 g/m$^2$
Gelatin: 2.5 g/m$^2$
(2) Protective layer
2,4-Dichloro-6-hydroxy-s-triazine Na salt: 0.05 g/m$^2$
Gelatin: 1.3 g/m$^2$

Samples 102 to 105

FR compounds of the present invention were emulsified simultaneously with the magenta coupler, $MC_p1$, as follows and added to the emulsion layer of Sample 101 to prepare Samples 102 to 105.

Sample 102: Compound I-1: 0.1 g/m$^2$
Sample 103: Compound I-15: 0.3 g/m$^2$
Sample 104: Compound I-32: 0.6 g/m$^2$
Sample 105: Compound I-25: 0.3 g/m$^2$

Sample 106

Sample 106 was prepared in the same manner as with Sample 101 except for replacing Emulsion A in Sample 101 by Emulsion B.

Samples 107 to 110

Samples 107 to 110 were prepared by adding FR compounds of the present invention, I-1, I-15, I-32, and I-25, in the same amount as in Samples 102 to 105 respectively, to the emulsion layer of Sample 106.

These samples were exposed for sensitometry, followed by conducting the following color development processing:

Densities of the thus processed samples were measured through a green filter to obtain the results tabulated in Table 1.

Graininess was evaluated according to conventional RMS method. An aperture for the measurement was of a diameter of 48μ.

The development processing employed herein was conducted as follows at 38° C.

1. Color develoment: 3 min. and 15 sec.
2. Bleaching: 6 min. and 30 sec.
3. Washing with water: 3 min. and 15 sec.
4. Fixing: 6 min. and 30 sec.
5. Washing with water: 3 min. and 15 sec.
6. Stabilizing: 3 min. and 15 sec.

Formulations of the processing solutions used in respective steps are as follows.

Color developer:
- Sodium nitrilotriacetate: 1.0 g
- Sodium sulfite: 4.0 g
- Sodium carbonate: 30.0 g
- Potassium sulfate: 1.4 g
- Hydroxylamine sulfate: 2.4 g
- 4-(N-Ethyl-N-β-hydroxyethylamino)-2-methylaniline sulfate: 4.5 g
- Water to make: 1 liter Bleaching solution:
- Ammonium bromide: 160.0 g
- Aqueous ammonia (28%): 25.0 ml
- Sodium iron ethylenetetraacetate: 130.0 g
- Glacial acetic acid: 14.0 ml
- Water to make: 1 liter Fixing solution:
- Sodium tetrapolyphosphate: 2.0 g
- Sodium sulfite: 4.0 g
- Ammonium thiosulfate (70%): 175.0 ml
- Sodium bisulfite: 4.6 g
- Water to make: 1 liter Stabilizing solution:
- Formalin: 8.0 ml
- Water to make: 1 liter

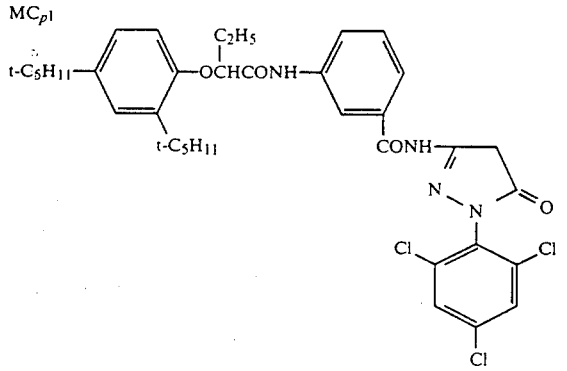

TABLE 1

| Sample | Emulsion | FR Compound | Photographic Properties: Relative Sensitivity | Photographic Properties: RMS Value |
|---|---|---|---|---|
| 101 | A | none | 100 | 0.073 |
| 102 | A | I-1 | 150 | 0.088 |
| 103 | A | I-15 | 141 | 0.085 |
| 104 | A | I-32 | 135 | 0.083 |

TABLE 1-continued

| Sample | Emulsion | FR Compound | Photographic Properties: Relative Sensitivity | Photographic Properties: RMS Value |
|---|---|---|---|---|
| 105 | A | I-25 | 141 | 0.085 |
| 106 | B | none | 98 | 0.070 |
| 107 | B | I-1 | 162 | 0.081 |
| 108 | B | I-15 | 154 | 0.079 |
| 109 | B | I-32 | 144 | 0.077 |
| 110 | B | I-25 | 150 | 0.078 |

The relative sensitivities are presented as relative values of reciprocals of exposure amounts necessary for attaining an effective density of 0.2 excluding fog, taking the sensitivity of Sample 101 as 100, and RMS values are values of portions having a density of (fog+0.2).

It is seen from Table 1 that Samples 107 to 110 of the present invention wherein a high-iodide content emulsion and a FR compound were used in combination showed higher sensitivities and better graininess presented as RMS values than Samples 102 to 105 wherein a low-iodide content emulsion and the FR compound were used in combination.

EXAMPLE 2

Preparation of Emulsion C 800 ml of an aqueous solution containing 0.33 mol of silver nitrate was added to 1,000 ml of a 2% gelatin aqueous solution containing 0.41 mol of potassium bromide and 0.06 mol of potassium iodide stirred at 80° C. over a 50-minute period. After physical ripening for 20 minutes, 1,000 ml of an aqueous solution containing 0.67 mol of silver nitrate and 0.67 mol/liter of potassium bromide were simultaneously added thereto over a 100-minute period, during which period the pAg was maintained at 8.6. After washing with water in a conventional manner, $1\times10^{-5}$ mol of sodium thiosulfate and $2\times10^{-5}$ mol of chloroauric acid were added thereto, followed by chemical ripening at 60° C. for 60 minutes. Thus, there was obtained a silver bromoiodide emulsion (Emulsion C) having a mean grain size of 2.1 μm and containing 6 mol% silver iodide.

Preparation of Emulsion D

A silver bromiodide emulsion having a mean grain size of 2.0 μm and containing 10 mol% silver iodide (Emulsion D) was prepared in the same manner as with Emulsion C except for using a 2% gelatin aqueous solution containing 0.37 mol of potassium bromide and 0.10 mol of potassium iodide.

Preparation of Emulsion E

A silver bromoiodide emulsion having a mean grain size of 2.0 μm and containing 14 mol% silver iodide (Emulsion E) was prepared in the same manner as with Emulsion C except for using a 2% gelatin aqueous solution containing 0.33 mol of potassium bromide and 0.14 mol of potassium iodide.

Then, emulsion layers and auxiliary layers having the following formulations were coated on a subbed triacetyl cellulose film base to prepare Sample 201.

Sample 201

1st layer: antihalation layer

A gelatin layer containing:
- Black colloidal silver: 0.18 g/m$^2$
- Ultraviolet ray absorbent C-1: 0.12 g/m$^2$
- Ultraviolet ray absorbent C-2: 0.17 g/m$^2$ 2nd layer: interlayer
A gelatin layer containing:
2,5-Di-t-pentadecylhydroquinone: 0.18 g/m$^2$
Coupler C-3: 0.11 g/m$^2$
AgBrI emulsion (AgI: 1 mol%; mean grain size: 0.07 μm): 0.15 g of Ag/m$^2$ 3rd layer: first red-sensitive emulsion layer
A gelatin layer containing:
AgBrI emulsion (AgI: 6 mol%; mean grain size: 0.6 μm): 0.72 g of Ag/m$^2$
Sensitizing dye I: $7.0\times10^{-5}$ mol/mol Ag
Sensitizing dye II: $2.0\times10^{-5}$ mol/mol Ag
Sensitizing dye III: $2.8\times10^{-4}$ mol/mol Ag
Sensitizing dye IV: $2.0\times10^{-5}$ mol/mol Ag
Coupler C-4: 0.93 g/m$^2$
Coupler C-5: 0.31 g/m$^2$
Coupler C-6: 0.010 g/m$^2$ 4th layer: second red-sensitive emulsion layer
A gelatin layer containing
AgBrI emulsion (AgI: 10 mol%; mean grain size: 1.6 μm): 1.6 g of Ag/m$^2$
Sensitizing dye I: $5.2\times10^{-5}$ mol/mol Ag
Sensitizing dye II: $1.5\times10^{-5}$ mol/mol Ag
Sensitizing dye III: $2.1\times10^{-4}$ mol/mol Ag
Sensitizing dye IV: $1.5\times10^{-5}$ mol/mol Ag
Coupler C-4: 0.10 g/m$^2$
Coupler C-5: 0.061 g/m$^2$
Coupler C-6: 0.005 g/m$^2$
Coupler C-7: 0.046 g/m$^2$ 5th layer: third red-sensitive emulsion layer
A gelatin layer containing:
AgBrI emulsion (AgI: 12 mol%;
mean grain size: 2.2 μm): 1.6 g of Ag/m$^2$
Sensitizing dye I: $5.5\times10^{-5}$ mol/mol Ag
Sensitizing dye II: $1.6\times10^{-5}$ mol/mol Ag
Sensitizing dye III: $2.2\times10^{-5}$ mol/mol Ag
Sensitizing dye IV: $1.6\times10^{-5}$ mol/mol Ag
Coupler C-5: 0.044 g/m$^2$
Coupler C-6: 0.004 g/m$^2$
Coupler C-7: 0.16 g/m$^2$ 6th layer: interlayer
A gelatin layer.

7th layer: first green-sensitive emulsion layer
A gelatin layer containing:
AgBrI emulsion (AgI: 5 mol%; mean grain size: 0.5 μm): 0.55 g of Ag/m$^2$
Sensitizing dye V: $3.8\times10^{-4}$ mol/mol Ag
Sensitizing dye VI: $3.0\times10^{-5}$ mol/mol Ag
Sensitizing dye VII: $1.2\times10^{-4}$ mol/mol Ag
Coupler C-8: 0.29 g/m$^2$
Coupler C-9: 0.040 g/m$^2$
Coupler C-10: 0.055 g/m$^2$
Coupler C-11: 0.058 g/m$^2$ 8th layer: second green-sensitive emulsion layer
A gelatin layer containing:
AgBrI emulsion (AgI: 6 mol%; mean grain size: 1.5 μm): 1.5 g of Ag/m$^2$
Sensitizing dye V: $2.7\times10^{-4}$ mol/mol Ag
Sensitizing dye VI: $2.1\times10^{-5}$ mol/mol Ag
Sensitizing dye VII: $8.5\times10^{-5}$ mol/mol Ag
Coupler C-8: 0.25 g/m$^2$
Coupler C-9: 0.014 g/m$^2$
Coupler C-10: 0.009 g/m$^2$
Coupler C-11: 0.011 g/m$^2$ 9th layer: third green-sensitive emulsion layer
A gelatin layer containing
AgBrI emulsion (AgI: 10 mol%; mean grain size: 2.2 μm): 1.5 g of Ag/m$^2$
Sensitizing dye V: $3.0\times10^{-4}$ mol/mol Ag
Sensitizing dye VI: $2.4\times10^{-5}$ mol/mol Ag
Sensitizing dye VII: $9.5\times10^{-5}$ mol/mol Ag 10th layer: yellow filter layer
A gelatin layer containing:
Yellow colloidal silver: 0.04 g/m$^2$
2,5-Di-t-pentadecylhydroquinone: 0.031 g/m$^2$ 11th layer: first blue-sensitive emulsion layer
A gelatin layer containing:
AgBrI emulsion (AgI: 6 mol%; mean grain size: 0.4 μm): 0.32 g of Ag/m$^2$
Coupler C-13: 0.68 g/m$^2$
Coupler C-14: 0.030 g/m$^2$ 12th layer: second blue-sensitive emulsion layer
A gelatin layer containing:
AgBrI emulsion (AgI: 10 mol%; mean grain size: 1.0 μm): 0.40 g of Ag/m$^2$
Sensitizing dye VIII: $2.2\times10^{-4}$ mol/mol Ag
Coupler C-13: 0.22 g/m$^2$ 13th layer: fine-grain emulsion layer
A gelatin layer containing:
AgBrI emulsion (AgI: 2 mol%; mean grain size: 0.15 μm): 0.25 g of Ag/m$^2$ 14th layer: third blue-sensitive emulsion layer
Emulsion C: 0.40 g of Ag/m$^2$
Sensitizing dye VIII: $2.3\times10^{-4}$ mol/mol Ag
Coupler C-13: 0.19 g/m$^2$ 15th layer: first protective layer
A gelatin layer containing:
Ultraviolet ray absorbent C-1: 0.14 g/m$^2$
Ultraviolet ray absorbent C-2: 0.22 g/m$^2$ 16th layer: second protective layer
A gelatin layer containing:
Polymethyl methacrylate particles (mean particle size: 1.5μ): 0.05 g/m$^2$
AgBrI emulsion (AgI: 2 mol%; mean grain size: 0.07 μm): 0.30 g of Ag/m$^2$ Each layer contained a gelatin hardener and a surfactant in addition to the above-described components.

Samples 202 and 203

Samples 202 and 203 were prepared by adding FR compound of the present invention to the 14th layer of Sample 201 as follows.
Sample 202: I-6: 0.8 g/m$^2$
Sample 203: I-37: 1.0 g/m$^2$ Samples 204 to 206

Samples 204 to 206 were prepared in the same manner as with Samples 201 to 203 except for replacing Emulsion C of the 14th layer by Emulsion D.

Samples 207 to 209

Samples 207 to 209 were prepared in the same manner as with Samples 201 to 203 except for replacing Emulsion C of the 14th layer by Emulsion E.

A pair of each sample, (A) and (B), were subjected to exposure for sensitometry, with (A) having been left for 30 days at room temperature and (B) having been left for 30 days at 50° C. under the condition of 30%RH, then subjected to the same color development processing as in Example 1. Densities of the developed samples were measured through a blue filter to obtain photographic properties given in Table 2.

TABLE 2

| Sample | Emulsion | FR Compound | Relative Sensitivity under (A) | Relative Sensitivity under (B) |
|---|---|---|---|---|
| 201 | C | none | 100 | 89 |
| 202 | C | I-6 | 117 | 100 |
| 203 | C | I-37 | 114 | 100 |
| 204 | D | none | 103 | 91 |
| 205 | D | I-6 | 123 | 107 |
| 206 | D | I-37 | 120 | 105 |
| 207 | E | none | 100 | 91 |
| 208 | E | I-6 | 129 | 114 |

TABLE 2-continued

| Sample | Emulsion | FR Compound | Relative Sensitivity under (A) | Relative Sensitivity under (B) |
|---|---|---|---|---|
| 209 | E | I-37 | 126 | 110 |

The sensitivities are presented as relative values of reciprocals of exposure amounts required for attaining an effective density of 0.2 excluding fog, taking the sensitivity of Sample 201 (A) as 100.

It is clear from Table 2 that samples to which the present invention was applied showed high sensitivities and suffered less reduction in sensitivity by allowing to stand at elevated temperature, thus showing more sensitivities than comparative samples after allowing to stand.

Graininess of the processed samples was observed at a portion of fog+0.2 in density under an optical microscope. Thus, Samples 205, 206, 208, and 209 in accordance with the present invention were found to give good graininess in spite of the higher sensitivities than that of Samples 202 and 203 which were combined with Emulsion C containing a low content of silver iodide.

Structures of the additives used in Example 2 are shown below.

C-1

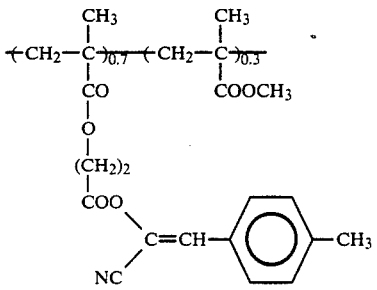

(Polymer; Molecular weight: about 25,000)

C-2

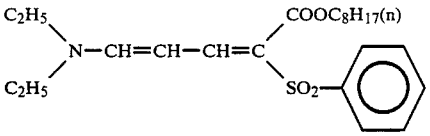

C-3

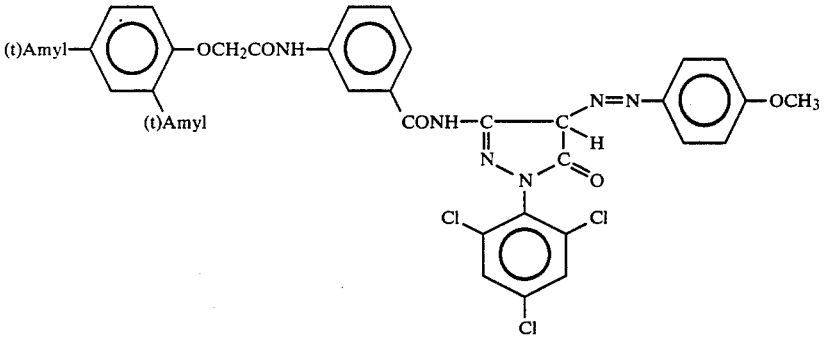

C-4

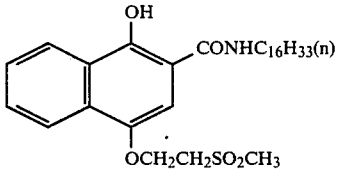

C-5

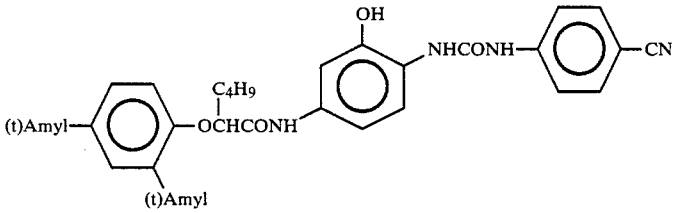

-continued
C-6
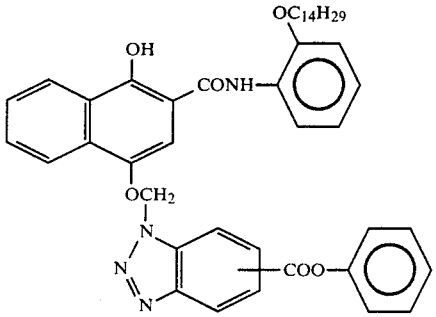
C-7
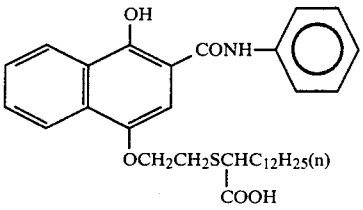
C-8
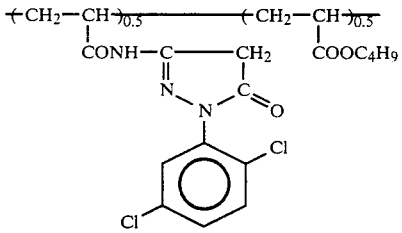
(Polymer; Molecular weight: about 20,000)
C-9
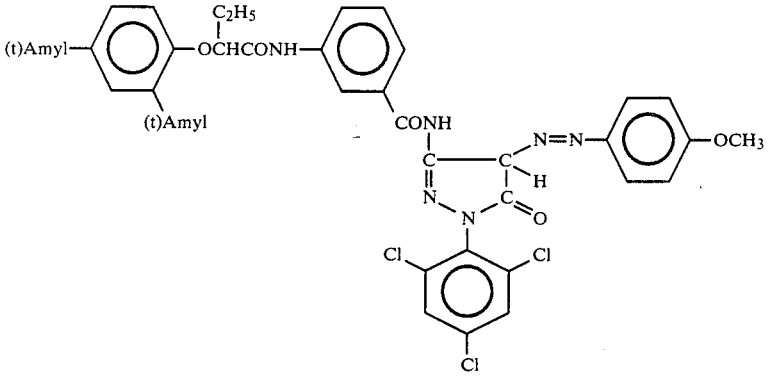
C-10
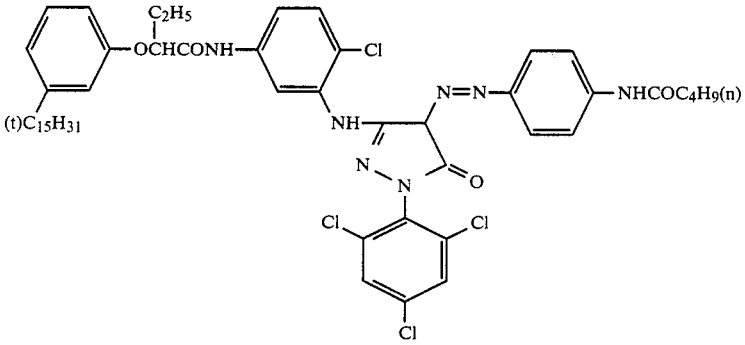

-continued
C-11
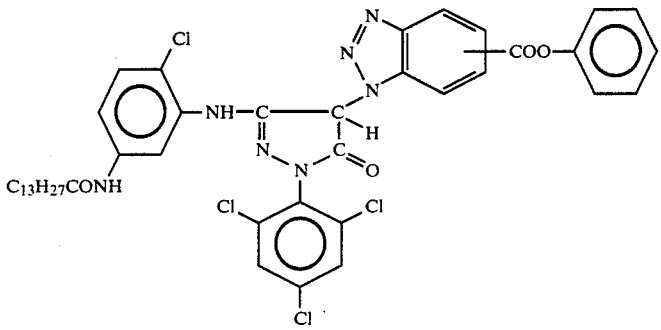
C-12
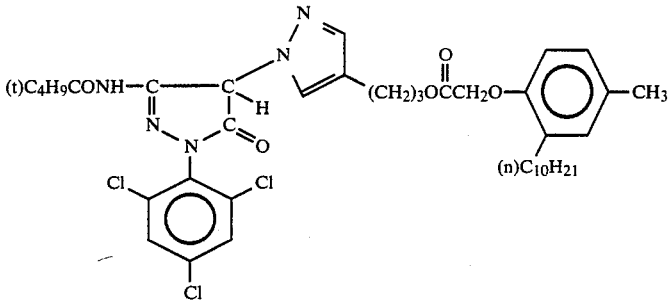
C-13
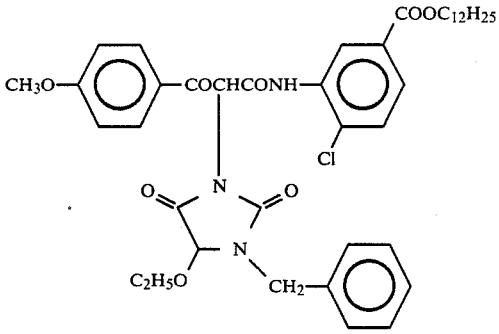
C-14
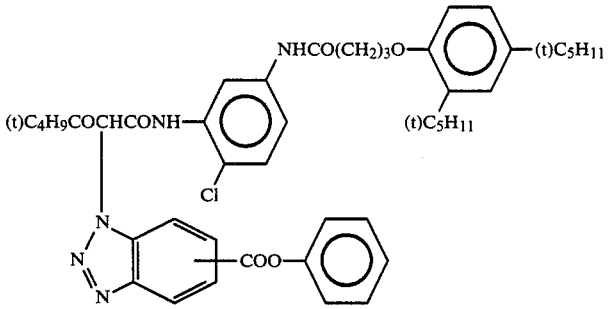
C-15
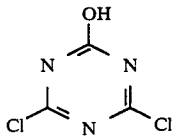
I
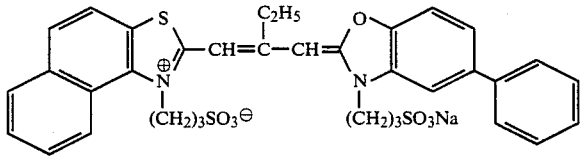

-continued

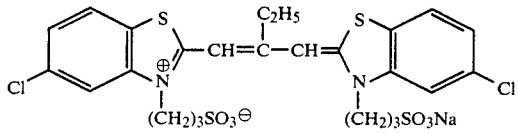

II

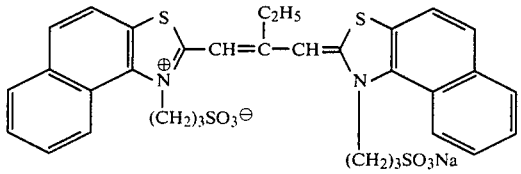

III

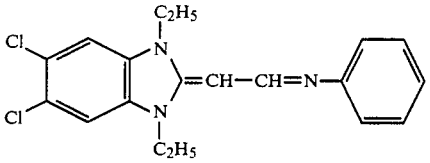

IV

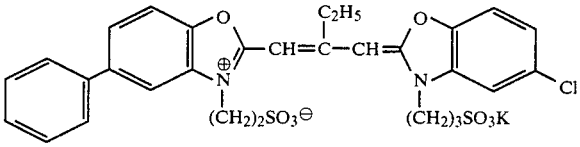

V

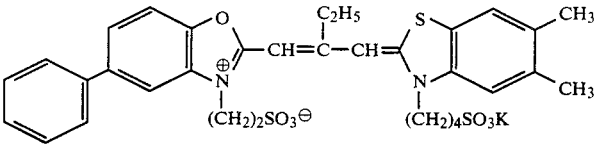

VI

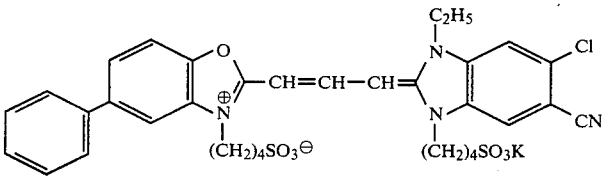

VII

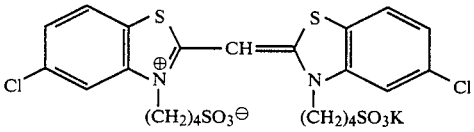

VIII

EXAMPLE 3

Samples 201 to 209 obtained in Example 2 were subjected to the same sensitometry exposure as in Example 2, and developed as follows. Densities of the developed samples were measured through a blue filter to obtain results given in Table 3.

| Processing step | Tem. (°C.) | Time |
|---|---|---|
| (1) Pre-bath | 27 ± 1 | 10 sec. |
| (2) Removal of backing and spray washing | 27–38 | 5 sec. |
| (3) Color development | 41.1 ± 0.1 | 3 min. |
| (4) Stopping | 27–38 | 30 sec. |
| (5) Bleaching acceleration | 27 ± 1 | 30 sec. |
| (6) Bleaching | 27 ± 1 | 3 min. |
| (7) Washing with water | 27–38 | 1 min. |
| (8) Fixing | 38 ± 1 | 2 min. |
| (9) Washing with water | 27–38 | 2 min. |

-continued

| Processing step | Tem. (°C.) | Time |
|---|---|---|
| (10) Stabilizing | 27–38 | 10 sec. |

Formulations of the processing solutions used in respective processing steps are as follows.

Formulation of processing solution (1) Pre-bath:

27°–38° C. Water: 800 ml
Borax (10 hydrate): 20.0 g
Sodium sulfate (anhydrous): 100 g
Sodium hydroxide: 1.0 g
Water to make: 1 liter
pH (27° C.): 9.25

(3) Color developer:

21°–38° C. Water: 850 ml
Kodak Anticalcium No. 4: 2.0 ml

Sodium sulfite (anhydrous): 2.0 g
Eastman antifog No. 9: 0.22 g
Sodium bromide (anhydrous): 1.20 g
Sodium carbonate (anhydrous): 25.6 g
Sodium bicarbonate: 2.7 g
Color developing agent: 4-(N-ethyl-N-β-methanesulfonamidoethyl)-m-toluidine: 4.0 g
Water to make: 1 liter
pH (27° C.): 10.20

(4) Stopping solution:
21°-38° C. Water: 900 ml
7.0N sulfuric acid: 50 ml
Water to make: 1 liter
pH (27° C.): 0.9

(5) Bleaching-accelerating solution:
Water: 900 ml
Sodium metabisulfite (anhydrous): 10.0 g
Glacial acetic acid: 25.0 ml
Sodium acetate: 10.0 g
EDTA-4 Na: 0.7 g
PBA: 5.5 g
Water to make: 1 liter
pH (27° C.): 3.8±0.2

PBA stands for 2-dimethylaminoethylisothiourea dihydrochloride.

(6) Bleaching solution:
24°-38° C. Water: 800 ml
Gelatin: 0.5 g
Sodium persulfate: 33.0 g
Sodium chloride: 15.0 g
Sodium primary phosphate (anhydrous): 9.0 g
Phosphoric acid (85%): 2.5 ml
Water to make: 1 liter
pH (27° C.): 2.3±0.2

(8) Fixing solution:
20°-38° C. Water: 700 ml
Kodak anticalcium No. 4: 2.0 ml 58% Ammonium thiosulfate solution: 185 ml
Sodium sulfite (anhydrous): 10.0 g
Sodium bisulfite (anhydrous): 8.4 g
Water to make: 1 liter
pH (27° C.): 6.5

(10) Stabilizing solution:
21°-27° C. Water: 1 liter
Kodak Stabilizer additive: 0.14 ml
Formalin (37.5% solution): 1.50 ml

TABLE 3

| Sample | Relative Sensitivity |
|---|---|
| 201 | 100 |
| 202 | 117 |
| 203 | 114 |
| 204 | 102 |
| 205 | 126 |
| 206 | 123 |
| 207 | 100 |
| 208 | 135 |
| 209 | 129 |

As is clear from Table 3, samples in accordance with the present invention showed remarkably high sensitivities.

Observation of graininess of the processed samples in the same manner as in Example 2 revealed that the samples in accordance with the present invention showed excellent graininess.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising a support having provided thereon at least one silver halide emulsion layer and containing, in a silver halide emulsion layer having an average iodide content of about 10 mol% to about 30 mol%, a compound capable a development accelerator or a precursor thereof upon development in proportion to the amount of developed silver.

2. The silver halide photographic light-sensitive material as claimed in claim 1, wherein said compound is employed in an amount of from $10^{-8}$ to $5\times10^{-1}$ mol per mol of silver halide.

3. The silver halide photographic light-sensitive material as claimed in claim 2, wherein said compound is employed in an amount of from $5\times10^{-7}$ to $10^{-2}$ mol per mol of silver halide.

4. The silver halide photographic light-sensitive material as claimed in claim 1, wherein said compound is selected from the group consisting of (i) couplers capable of coupling with an oxidation product of an aromatic primary amine developing agent to release a fogging agent, a development accelerator, or a precursor thereof; (ii) couplers capable of coupling with an oxidation product of an aromatic primary amine developing agent to form a diffusible (colored or colorless) dye having a fogging moiety or a development-accelerating moiety, or a precursor thereof; and (iii) compounds causing an oxidation-reduction reaction with an oxidation product of a developing agent and releasing a fogging agent, a developing accelerator or a precursor thereof by hydrolysis reaction occuring subsequent to the oxidation-reduction reaction.

5. The silver halide photographic light-sensitive material as claimed in claim 4, wherein said compounds (i), (ii) and (iii) are represented by Formulae (1), (2) and (3), respectively.

(1) COUP-1-(TIME-1)$_n$-FA
(2) FOG-(COUP-2)-BALL
(3) RED-W wherein COUP-1 represents a coupler moiety capable of undergoing a coupling reaction with an oxidation product of an aromatic primary amine developing agent, (TIME-1)$_n$-FA represents a moiety containing a group to be released by the coupling reaction and capable of fogging silver halide or capable of accelerating development, or a precursor thereof, n represents 0 to 1, FA represents, when n equals 0, a group capable of being cleaved from COUP-1 upon a coupling reaction or represents, when n equals 1, a group to be released from TIME-1, which has the effect of substantially fogging silver halide grains or of accelerating development, FOG represents a group exhibiting a fogging or developing-accelerating effect in the developer after cleavage of BALL by the reaction with an oxidation product of an aromatic primary amine developing agent, COUP-2 represents a group capable of undergoing a coupling reaction with an oxidation product of an aromatic primary amine developing agent, BALL represents a ballast group having such size and configuration as to confer sufficient non-diffusibility to a coupler attached to the coupling position of COUP-2 and capable of cleaving from COUP-2 by the reaction between COUP-2 and an oxidation product of an aromatic primary amine developing agent, RED is represented by general formulae (XX) to (XXV):

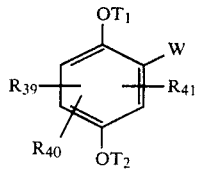
(XX)

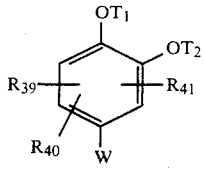
(XXI)

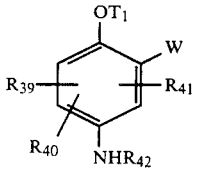
(XXII)

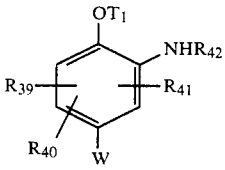
(XXIII)

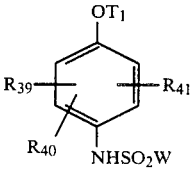
(XXIV)

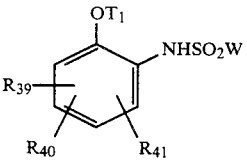
(XXV)

in the general formulae (XX) to (XXV), $R_{39}$, $R_{40}$ and $R_{41}$ may be the same or different and each represents a hydrogen atom, a halogen atom, an alkyl group, an aryl group, an alkoxy group, an aryloxy group, an alkylthio group, an arylthio group, a cyano group, an alkoxycarbonyl group, a carbamoyl group, a sulfamoyl group, a carboxy group, a sulfo group, a sulfonyl group, an acyl group, a cyano group, a carbonamido group, a sulfonamido group or a heterocyclic group, with $R_{39}$ and $R_{40}$ being optionally bound to each other to form a benzene ring or a 5- to 7-membered ring, $R_{42}$ represents an alkyl group, an aryl group, an acyl group, a carbamoyl group, a sulfonyl group or a sulfamoyl group, $T_1$ and $T_2$ may be the same or different and each represents a group capable of being cleaved by hydrolysis under proton-acidic or alkaline condition, W directly joined to a benzene ring [the general formulae (XX) to (XXIII)] represents a group which, after being cleaved, exhibits a fogging action in a developer, and W joined to a —$NHSO_2$— group [the general formulae (XXIV) and (XXV)] represents a group which, after being cleaved as W-$SO_2NH_2$, exhibits a fogging action in a developer.

6. The silver halide photographic light-sensitive material as claimed in claim 5, wherein said COUP-1 is represented by general formulae (I) to (X):

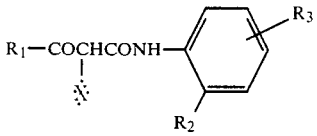
(I)

wherein $R_1$ represents an alkyl group, an aryl group, a heterocyclic group, an alkoxy group, an alkylamino group or an anilino group, $R_2$ represents a hydrogen atom, a halogen atom, an alkyl group, an alkoxy group or an aryloxy group, and $R_3$ represents a hydrogen atom, an alkyl group, an alkoxy group, an acyl group, an aryloxy group, a sulfonyl group, a carbonamido group, a hydroxy group, a carboxy group, a sulfo group, a sulfonamido group, an alkoxycarbonyl group, a carbamoyl group, a sulfamoyl group, a ureido group or a halogen atom;

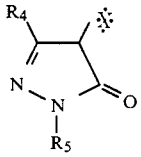
(II)

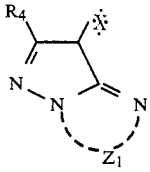
(III)

wherein $R_4$ represents an alkoxy group, an alkylamino group, a dialkylamino group, an alkyl group, a carbonamido group or a sulfonamido group, $R_5$ represents an alkyl group or an aryl group, and $Z_1$ represents non-metallic atoms necessary for forming a 5-membered azole ring, provided that the general formula (III) includes the tautomers thereof,

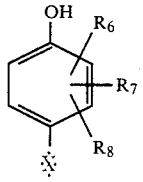
(IV)

-continued (V)

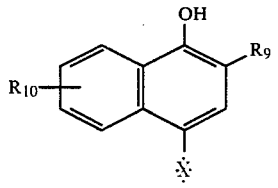

wherein $R_6$, $R_7$, and $R_8$ may be the same or different and each represents a hydrogen atom, a halogen atom, an alkyl group, an alkoxy group, an alkylthio group, a ureido group, a carbonamido group or a sulfonamido group, $R_9$ represents a carbamoyl group or an alkoxycarbonyl group, and $R_{10}$ represents a hydrogen atom, a halogen atom, an alkyl group, an alkoxy group or an alkylthio group;

(VI)

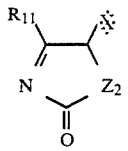

wherein $R_{11}$ represents an alkyl group, an aryl group, an anilino group, an alkylamino group or an alkoxy group, and $Z_2$ represents an oxygen atom, a sulfur atom or a nitrogen atom, and (VII)

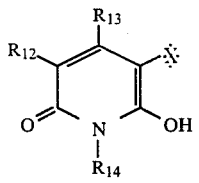

wherein $R_{12}$ and $R_{13}$ each represents a hydrogen atom, a cyano group, an alkoxycarbonyl group, a carbamoyl group, a sulfo group or an acyl group, and $R_{14}$ represents a hydrogen atom, an alkyl group, an aryl group or a heterocyclic group, and (VIII)

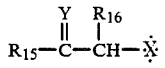

(IX)

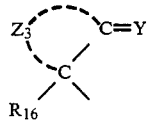

wherein $R_{15}$ represents an alkyl group, an aryl group, a heterocyclic group, a cyano group, a hydroxy group, an alkoxy group, an aryloxy group, a hetero ring oxy group, an alkylamino group, a dialkylamino group, an anilino group, a sulfonyl group, a sulfamoyl group or an ammoniumyl group, $R_{16}$ represents a hydrogen atom, an alkyl group, an aryl group, a halogen atom, an alkoxy group, an acyloxy group, or a heterocyclic group, Y represents an oxygen atom or $=N-R_{17}$, and $R_{17}$ represents an alkyl group, an aryl group, a hydroxy group, an alkoxy group or a sulfonyl group, $Z_3$ represents non-metallic atoms necessary for forming, together with a

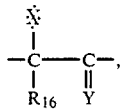

a 5- to 7-membered carbon ring or a hetero ring; and (X)

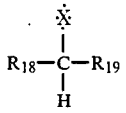

wherein $R_{18}$ and $R_{19}$ may be the same or different and each represents an alkoxycarbonyl group, a carbamoyl group, an acyl group, a cyano group, a formyl group, a sulfonyl group, a sulfinyl group, a sulfamoyl group, an ammoniumyl group or

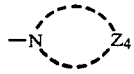

wherein $Z_4$ represents non-metallic atoms necessary for forming, together with

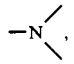

a 5- to 7-membered ring, and wherein in the above formulae (I) to (X), ⊗ represents the position to which $(TIME\text{-}1)_n$-FA is bound.

7. The silver halide photographic light-sensitive material as claimed in claim 5, wherein said FA is represented by the general Formula $(L)_m$-X, wherein L represents a divalent linking group, X represents a reductive group or a group capable forming silver sulfide upon development, and m represents 0 or 1.

8. The photographic light-sensitive material as claimed in claim 7, wherein said devalent linking group is selected from the group consisting of alkylene, alkenylene, phenylene, naphthylene, —O—, —S—, —SO—, $—SO_2—$, —N=N—, carbonamido, thioamido, sulfonamido, ureido, thioureido and hetero ring.

9. The photographic light-sensitive material as claimed in claim 7, wherein X is selected from the group consisting of hydrazine, hydrazide, hydrazone, hydroquinone, catechol, p-aminophenol, p-phenylenediamine, 1-phenyl-3-pyrazolidinone, enamine, aldehyde, polyamine, acetylene, aminoborane, quaternary salts selected from the group consisting of tetrazolium salt, ethylenebispyridinium salts, carbazinic acid, thiourea, thioamide, dithiocarbamate, rhodanine, thiohydantoin and thiazolidinethione.

10. The photographic light-sensitive material as claimed in claim 5, wherein said COUP-2 is represented by general formula (I) to (X).

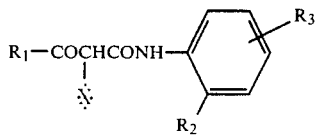

(I)

wherein $R_1$ represents an alkyl group, an aryl group, a heterocyclic group, an alkoxy group, an alkylamino group or an anilino group, $R_2$ represents a hydrogen atom, a halogen atom, an alkyl group, an alkoxy group or an aryloxy group, and $R_3$ represents a hydrogen atom, an alkyl group, an alkoxy group, an acyl group, an aryloxy group, a sulfonyl group, a carbonamido group, a hydroxy group, a carboxy group, a sulfo group, a sulfonamido group, an alkoxycarbonyl group, a carbamoyl group, a sulfamoyl group, a ureido group or a halogen atom;

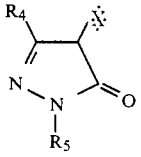

(II)

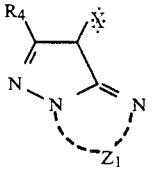

(III)

wherein $R_4$ represents an alkoxy group, an alkylamino group, a dialkylamino group, an alkyl group, a carbonamido group or a sulfonamido group, $R_5$ represents an alkyl group or an aryl group, and $Z_1$ represents non-metallic atoms necessary for forming a 5-membered azole ring, provided that the general formula (III) includes the tautomers thereof,

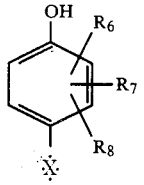

(IV)

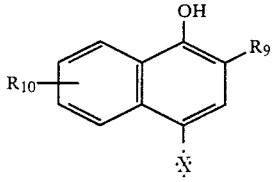

(V)

wherein $R_6$, $R_7$, and $R_8$ may be the same or different and each represents a hydrogen atom, a halogen atom, an alkyl group, an alkoxy group, an alkylthio group, a ureido group, a carbonamido group or a sulfonamido group, $R_9$ represents a carbamoyl group or an alkoxycarbonyl group, and $R_{10}$ represents a hydrogen atom, a halogen atom, an alkyl group, an alkoxy group or an alkylthio group;

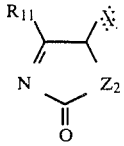

(VI)

wherein $R_{11}$ represents an alkyl group, an aryl group, an anilino group, an alkylamino group or an alkoxy group, and $Z_2$ represents an oxygen atom, a sulfur atom or a nitrogen atom, and

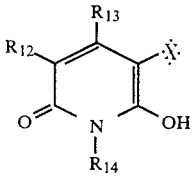

(VII)

wherein $R_{12}$ and $R_{13}$ each represents a hydrogen atom, a cyano group, an alkoxycarbonyl group, a carbamoyl group, a sulfo group or an acyl group, and $R_{14}$ represents a hydrogen atom, an alkyl group, an aryl group or a heterocyclic group;

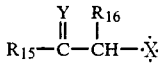

(VIII)

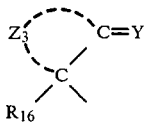

(IX)

wherein $R_{15}$ represents an alkyl group, an aryl group, a heterocyclic group, a cyano group, a hydroxy group, an alkoxy group, an aryloxy group, a hetero ring oxy group, an alkylamino group, a dialkylamino group, an anilino group, a sulfonyl group, a sulfamoyl group or an ammoniumyl group, $R_{16}$ represents a hydrogen atom, an alkyl group, an aryl group, a halogen atom, an alkoxy group, an acyloxy group, or a heterocyclic group, Y represents an oxygen atom or $=N-R_{17}$, and $R_{17}$ represents an alkyl group, an aryl group, a hydroxy group, an alkoxy group or a sulfonyl group, $Z_3$ represents non-metallic atoms necessary for forming, together with a

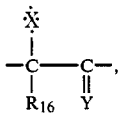

a 5- to 7-membered carbon ring or a hetero ring; and

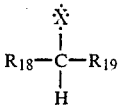

(X)

wherein $R_{18}$ and $R_{19}$ may be the same or different and each represents an alkoxycarbonyl group, a carbamoyl group, an acyl group, a cyano group, a formyl group, a sulfonyl group, a sulfinyl group, a sulfamoyl group, an ammoniumyl group or

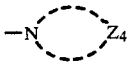

wherein $Z_4$ represents non-metallic atoms necessary for forming, together with

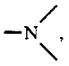

a 5- to 7-membered ring, and wherein, in the above formulae (I) to (X), $\dot{\ddot{X}}$ represents the position to which BALL is bound.

11. The silver halide light-sensitive material as claimed in claim 5, wherein the sum of the molecular weight of COUP-2 and that of FOG is up to 500.

12. The silver halide light-sensitive material as claimed in claim 5, wherein the sum of the molecular weight of COUP-2 and that of FOG is up to 400.

13. The silver halide light-sensitive material as claimed in claim 5, wherein said BALL is represented by general formulae (XI) to (XVII), an alkoxy group, an alkylthio group, and an acyloxy group, (XI)

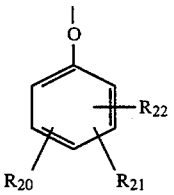

(XII)

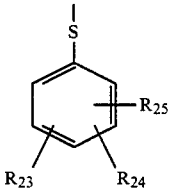

wherein $R_{20}$, $R_{21}$ and $R_{22}$ may be the same or different and each represents a hydrogen atom, a halogen atom, an alkyl group, an aryl group, an alkoxy group, an alkylthio group, a carbonamido group, a sulfonamido group, an acyl group, a sulfinyl group, a sulfonyl group, an alkoxycarbonyl group, an alkoxysulfonyl group, a carbamoyl group, a sulfamoyl group, a carboxy group, a sulfo group, a cyano group or a nitro group, and $R_{23}$, $R_{24}$, and $R_{25}$ may be the same or different and each represents a hydrogen atom, a halogen atom, an alkyl group, an aryl group, an alkoxy group, an alkylthio group, an acyl group, an acylamino group, an alkoxycarbonyl group or an aryloxy group:

(XIII)

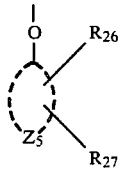

(XIV)

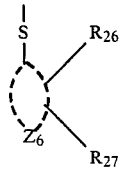

wherein $Z_5$ and $Z_6$ each represents non-metallic atoms necessary for forming a 5- to 7-membered ring, and $R_{26}$ and $R_{27}$ may be the same or different and each represents a hydrogen atom, a halogen atom, an alkyl group, an alkoxy group, an aryl group, an alkylthio group, an arylthio group, a carbonamido group or a sulfonamido group;

(XV)

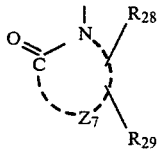

(XVI)

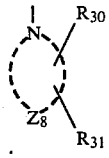

(XVII)

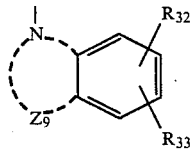

wherein $Z_7$ represents non-metallic atoms necessary for forming a 5- to 7-membered hetero ring together with

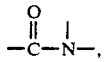

$Z_8$ represents non-metallic atoms necessary for forming an azole ring together with

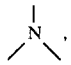

$Z_9$ represents non-metallic atoms necessary for forming an indole ring, an indazole ring, a benzimidazole ring or a benzotriazole ring together with

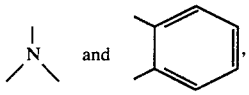

$R_{28}$ and $R_{29}$ may be the same or different and each represents a hydrogen atom, a halogen atom, an alkyl group, an aryl group, an alkoxy group, an aryloxy group, an alkylthio group, an arylthio group, an alkylamino group, a dialkylamino group, an anilino group, an alkoxycarbonyl group, a carbamoyl group, a sulfinyl group, a sulfonyl group, an acyloxy group, a carbonamido group or a sulfonamido group, $R_{30}$ and $R_{31}$ may be the same or different and each represents a hydrogen atom, a halogen atom, an alkyl group, an alkoxy group, an aryl group, an alkylthio group, an alkoxycarbonyl group, a carbamoyl group, a cyano group, an aryloxy group, a carbonamido group, a sulfonamido group or an ureido group, and $R_{32}$ and $R_{33}$ may be the same or different and each represents a hydrogen atom, a halogen atom, an alkyl group, an aryl group, an alkoxy group, an aryloxy group, an alkylthio group, an arylthio group, an alkoxycarbonyl group, an aryloxycarbonyl group, a carbamoyl group, a carbonamido group, a sulfonamido group, a sulfamoyl group or an ureido group.

14. The silver halide photographic light-sensitive material as claimed in claim 13, wherein in general formulae (XI) to (XVII) the sum of the number of carbon atoms of each substituent ranges from 8 to 32.

15. The silver halide phtographic light-sensitive material as claimed in claim 14, wherein in general formulae (XI) to (XVII) the sum of the number of carbon atoms of each substituent ranges from 12 to 24.

16. The silver halide photographic light-sensitive material as claimed in claim 5, wherein FOG has the partial structures represented by general formulae (XVIII) and (XIX):

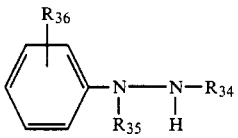

(XVIII)

wherein $R_{34}$ represents an acyl group, a sulfonyl group or an alkoxycarbonyl group, $R_{35}$ represents a hydrogen atom, an alkoxycarbonyl group or an acyl group, and $R_{36}$ represents a hydrogen atom, an alkyl group, an alkoxy group, a carbonamido group, a ureido group, an aryloxy group or a halogen atom, with the group represented by the general formula of (XVIII) being attached to COUP-2 at a position on $R_{34}$, $R_{35}$, $R_{36}$ or phenyl ring via a divalent group or

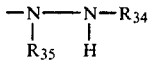

being directly attached to the aryl ring of COUP-2;

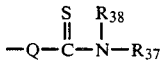

(XIX)

wherein

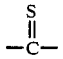

represents a thiocarbonyl group, $R_{37}$ and $R_{38}$ each represents independently a hydrogen atom, an alkyl group, an aryl group or an acyl group, Q represents alkylene, alkenylene, arylene, —O—, —S—, or

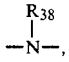

with this group being attached to COUP-2 via a divalent group or directly as with the group of the general formula (XVIII).

17. The silver halide photographic light-sensitive material as claimed in claim 5, wherein said $T_1$ and $T_2$ each represents a hydrogen atom, an acyl group, a sulfonyl group, an alkoxycarbonyl group, a carbamoyl group, an oxalyl group, and groups represented by the following general formulae (XXVI), (XXVII) and (XXVIII):

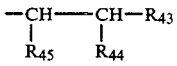

(XXVI)

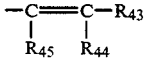

(XXVII)

wherein $R_{43}$ represents an acyl group, a sulfonyl group, a cyano group, a carbamoyl group, a sulfamoyl group, an alkoxycarbonyl group, a nitro group, a carboxy group, a sulfo group, or an ammoniumyl group, $R_{44}$ and $R_{45}$ may be the same or different and each represents a hydrogen atom, an alkyl group or that referred to with respect to $R_{43}$, with $R_{43}$ and $R_{45}$ being optionally bound to each other to form a 5- to 7-membered ring; and

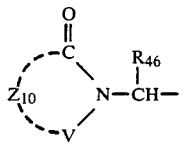

(XXVIII)

wherein $R_{46}$ represents a hydrogen atom, an alkyl group or an aryl group,

V represents

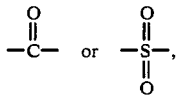

and $Z_{10}$ represents non-metallic atoms necessary for forming a 5- to 6-membered ring.

18. The silver halide photographic light-sensitive material as claimed in claim 5, wherein said W represents a group represented by the following general formula (XXIX):

$$\text{-}(\text{TIME-2})_m\text{-}L_1\text{-}(L_2)_k\text{-}W_1 \qquad \text{(XXIX)}$$

wherein

TIME-2 represents a so-called timing group capable of releasing, after release of W, $-L_1-(L_2)_k-W_1$, m represents 0 or an integer of 1, $L_1$ represents, where $l=0$, a cleavable group for cleaving W by oxidation-reduction reaction between the compound of the general formula (XX) to (XXV) and an oxidation product of a developing agent under alkaline conditions or, when $l=1$, a group capable of being cleaved from TIME-2 of cleaved W.

19. The silver halide light-sensitive material as claimed in claim 1, wherein the content of said silver iodide is from about 12 mol percent to about 25 mol percent.

* * * * *